US011505297B2

(12) United States Patent
Chelaru

(10) Patent No.: US 11,505,297 B2
(45) Date of Patent: Nov. 22, 2022

(54) ULTRA-LARGE MARINE SUBMERSIBLE TRANSPORT BOATS AND ARRANGEMENTS FOR TRANSPORTATION OF AQUEOUS BULK LIQUIDS, INCLUDING FRESH WATER

(71) Applicant: TRANSOCEANIC LLC, Sheridan, WY (US)

(72) Inventor: Silviu Dorian Chelaru, South Padre Island, TX (US)

(73) Assignee: TRANSOCEANIC LLC, Sheridan, WY (US)

( * ) Notice: Subject to any disclaimer, the term of this patent is extended or adjusted under 35 U.S.C. 154(b) by 0 days.

(21) Appl. No.: 17/287,569

(22) PCT Filed: Oct. 28, 2020

(86) PCT No.: PCT/US2020/057690

§ 371 (c)(1),
(2) Date: Apr. 22, 2021

(87) PCT Pub. No.: WO2021/101684

PCT Pub. Date: May 27, 2021

(65) Prior Publication Data

US 2022/0274677 A1 Sep. 1, 2022

Related U.S. Application Data

(60) Provisional application No. 62/974,230, filed on Nov. 20, 2019.

(51) Int. Cl.
*B63G 8/00* (2006.01)
*B63G 8/08* (2006.01)
(Continued)

(52) U.S. Cl.
CPC ..... *B63G 8/001* (2013.01); *B63G 8/04* (2013.01); *B63G 8/08* (2013.01); *B63G 8/22* (2013.01)

(58) Field of Classification Search
CPC . B63G 8/001; B63G 8/04; B63G 8/08; B63G 8/22
See application file for complete search history.

(56) References Cited

U.S. PATENT DOCUMENTS 3,085,533 A 4/1963 Goryl et al.
3,704,678 A 12/1972 Kelly
(Continued)

OTHER PUBLICATIONS

International Search Report and Written Opinion for PCT/US2020/057690, prepared by the U.S. Patent and Trademark Office dated Jan. 8, 2021.

*Primary Examiner* — Anthony D Wiest
(74) *Attorney, Agent, or Firm* — Brooks Kushaman P.C.

(57) ABSTRACT

Ultra-large marine submersible transport boats and arrangements for aqueous bulk liquids transportation, including fresh water and irrigation drainage, from specifically configured supply stations to specifically configured delivery stations. Boats present rigid hydrodynamic shaped double-walled submersible hulls incorporating a plurality of inside-reinforced impervious ballast chambers and also present radial reinforcing elements and hollow interior cavities that enclose collapsible bulk liquid bladders for transporting bulk liquids. Hulls can be made of reinforced concrete. Hull openings permit seawater circulation, avoiding transportation of bulk ballast seawater. Submersible cruising reduces structural loads and drag. An on-board hydro-pneumatic ballasting system adds to and removes reusable hull ballast water from, the ballast chambers controlling the hull's depth, pitch, and roll. Propulsion, steering capabilities, and detailed arrangements and methods for loading, unloading,
(Continued)

and transporting bulk liquids are presented. Hull manufacturing is done on marine floating platforms using onshore precast panels. Maintenance and end of life procedures are detailed.

31 Claims, 14 Drawing Sheets

(51) Int. Cl.
*B63G 8/22* (2006.01)
*B63G 8/04* (2006.01)

(56) References Cited

U.S. PATENT DOCUMENTS

| | | | | |
|---|---|---|---|---|
| 6,349,663 | B1 * | 2/2002 | Romano | B63B 1/048 114/256 |
| 7,500,442 | B1 * | 3/2009 | Schanz | B63G 8/42 114/256 |
| 7,841,289 | B1 | 11/2010 | Schanz | |
| 2002/0053311 | A1 | 5/2002 | Yaffe | |
| 2018/0237110 | A1 | 8/2018 | Szydlowski et al. | |

* cited by examiner 160
150
100
280
330
300
110
140
110
160
390
400
915
910
900
340
915
910
900
330
345
200
110
140
110
280
300
860
320

160
320
110
990
500
610
200
915
910
900
340
330
1000
990
500
610
980
150
300
100
320

ULTRA-LARGE MARINE SUBMERSIBLE TRANSPORT BOATS AND ARRANGEMENTS FOR TRANSPORTATION OF AQUEOUS BULK LIQUIDS, INCLUDING FRESH WATER

CROSS-REFERENCE TO RELATED APPLICATION

This application is the U.S. national phase of PCT Application No. PCT/US2020/057690 filed on Oct. 28, 2020, which claims the benefit of U.S. Provisional Application Ser. No. 62/974,230 filed, Nov. 20, 2019, the disclosures of which are hereby incorporated in their entirety by reference herein.

TECHNICAL FIELD

The present invention relates to ultra-large marine submersible transport boats that transport aqueous bulk liquids loading them from specifically built supply stations and unloading them to specifically built delivery stations, the most important transported bulk liquid being fresh water, with some possibilities for transportation of irrigation drainage water, tailings, and other bulk liquids with densities close to that of seawater. Also, the invention presents the operation, maintenance, and the critical assembly manufacturing of the ultra-large marine submersible transport boats, as well as their maintenance and end of life disposal.

BACKGROUND

Various liquid transportation and storage systems have been used to transport and store liquids in the marine environment; some of these systems could also be used for transporting fresh water.

Moreover, there is a clear need to transport large quantities of liquids, especially fresh water, between supply locations and delivery locations situated at large distances from each other.

However, transport through pipes becomes prohibitive with increased distances because of the cost of the pipes and of the high energy and power required.

A transportation system proposed by the related art is achieved as a towable submergible streamlined ellipsoid shaped hull made of collapsible materials like the one offered by Schanz's U.S. Pat. No. 7,500,442 of Mar. 10, 2009. Unfortunately, this system when built as a large transporter used for transportation of liquids of densities different than the seawater will present high deformations of its outside hull due to hydrostatic pressured differences, and when moving will withstand hydrodynamic flutter and shape instabilities of the hull skin that, also under the influence of waves or floating debris, can be destroyed.

The problem of hull deformation and debris damage is partially solved by Romano's U.S. Pat. No. 6,349,663 of Feb. 26, 2002, that introduces a double-skinned hull made of rigid material for an oil storage tank that can also be used for transport of oil. However, the intention of the invention is for a relatively small steel-made oil storage tank with a capacity of a maximum of 37000 cubic meters that navigates occasionally on the surface of the sea like a barge under stress from waves, with undefined roll and pitch stability and with no clear ballasting solution, and also with a lot of drag due to its non-hydrodynamic configuration.

Thus, there is still a need for a bulk liquid transportation system that can economically transport ultra-large quantities of liquids, especially fresh water, at large distances, that is stable, reliable, environment-friendly, and engineered so that it can meet all operational demands.

SUMMARY

An ultra-large marine submersible transport boat and arrangements for transportation of aqueous bulk liquids including fresh water are presented.

In one or more embodiments of the invention, the ultra-large submersible transport boat is built to be loaded with aqueous bulk liquids, transport them, and deliver the bulk liquids, and it comprises an elongate hydrodynamic-shaped rigid and hollow submersible hull that is double-walled and controllable-ballasted, built from heavier-than-seawater materials and having its double-wall formed by an outer shell and a spaced-apart inner shell joined by separating partitions defining a plurality of separate impervious ballast chambers therebetween that are controllably ballasted independently of each other by partially and controllably filling them with hull ballast water and controllably de-ballasted by the elimination of at least some of the chamber-contained hull ballast water, the submersible hull enclosing a plurality of collapsible bulk liquid bladders shaped to substantially occupy almost the whole free hollow inside of the submersible hull when filled with bulk liquids to be transported, and collapsing when emptied, the collapsible bulk liquid bladders being filled, emptied, and isolated by at least one bulk liquids transfer valve that is assembled in line with a bulk liquids transfer connector that sequentially and temporarily connects the collapsible bladers for the bulk liquids supply and delivery, the submersible hull having enough heavier-than-seawater material and the ballast chambers' volumes large enough, so that the ultra-large marine submersible transport boat with all its contained fluids in any operational status, can, by ballasting, respectively deballasting, be controllably submerged and also from a submerged position can be brought to the seawater surface, and by differential ballasting of the ballast chambers, can have its pitch, and roll controlled, also, the submersible hull having a multitude of hull openings communicating from the outside through the submersible hull, the ultra-large marine submersible transport boat also comprising an onboard hydro-pneumatic ballasting system that contains a ballasting command and control center that commands and control the feeding and extraction of hull ballast water and ballast air, into and from the ballast chambers, the ballasting system being also provided with a predetermined quantity of hull ballast water and a plurality of collapsible hull ballast water storage bags located within the submersible hull's hollow interior cavity, that store in a closed circuit the ballast water when removed from the ballast chambers and any other parts of the hydro-pneumatic ballasting system, the hydro-pneumatic ballasting system being provided with information from a vertical attitude indicator that is fitted on the ultra-large marine submersible transport boat and that indicates the engineering designated vertical, the hydro-pneumatic ballasting system being used to exchange hull ballast water amongst the ballast chambers for the ultra-large marine submersible transport boat's pitch and roll control in relation to the engineering designated vertical, the hydro-pneumatic ballasting system being provided with depth information from some depth sensors that are fitted on the ultra-large marine submersible transport boat, the hydro-pneumatic ballasting system, for depth control, being used to exchange hull ballast water between the ballast chambers and the plurality of collapsible hull ballast water storage bags, the hull ballast water being continuously reused and kept in close circuits separated from the surrounding seawater, and the air for deballasting being provided from and respectively released to the atmospheric air through an atmospheric air connection, the ultra-large marine submersible transport boat also comprising a snorkel tower that is affixed to the upper part of the submersible hull and that has a height that allows the ultra-large marine submersible transport boat to navigate at a specified depth in submersion while providing the atmospheric air connection access to the atmospheric air, the snorkel tower being a rigid and hydrodynamic structure, for maneuvering and cruising the ultra-large marine submersible transport boat being also provided at least one power generation group driving at least one propulsion mechanism enabling the ultra-large marine submersible transport boat to be propelled.

In an embodiment of the invention, the ultra-large marine submersible transport boat has its hydro-pneumatic ballasting system provided with a plurality of ballast water controllable pumps, ballast water accumulators, ballast water controllable valves, and ballast water distributors that actively supply under hydraulic pressure, respectively passively allows to evacuate under pneumatic pressure, the hull ballast water through a multitude of ballast water pipes independently to, respectively from, each ballast chamber, and also provided with a plurality of ballast air controllable compressors, controllable air valves, air accumulators, and air admission and air release tees connected through air ducts independently to each ballast chambers to controllably make the hull ballast water to be pneumatically evacuated and returned from the ballast chambers by injection of pressurized ballast air into the ballast chambers.

In one embodiment of the invention, the ultra-large marine submersible transport boat comprises a general command and control center that controls the hydro-pneumatic ballasting system the power generation group, and the propulsion mechanism, for the maneuvering and navigation of the ultra-large marine submersible transport boat.

In one embodiment of the invention, the ultra-large marine submersible transport boat comprises a plurality of chocks and towing pads mounted on the outside of the submersible hull, to which mooring and tug lines can be attached.

In one embodiment of the invention the ultra-large marine submersible transport boat is provided with at least one of the collapsible bulk liquids bladders, at least one bulk liquids transfer valves, and at least one of the bulk liquids transfer connectors that are in contact with the fresh water are compatible with fresh water as a transported bulk liquid and are built to keep its quality, the ultra-large marine submersible transport boat being used for the transportation of fresh water.

In one or more embodiments of the invention, the ultra-large marine submersible transport boat has an overall length of 400 to 2400 meters, a length to the maximum transverse dimensional ratio of 6 to 9, and the hollow interior cavity having a capacity of over 550,000 DWT.

In one embodiment of the invention, the ultra-large marine submersible transport boat has its submersible hull built with a rounded bow, a cylindrical middle section, and a tapered stern.

In one embodiment of the invention, the ultra-large marine submersible transport boat has its submersible hull built with a substantially circular transversal section.

In another embodiment of the invention, the ultra-large marine submersible transport boat has its submersible hull built with a substantially elliptical transversal section.

In another embodiment of the invention, the ultra-large marine submersible transport boat has its submersible hull provided with a cylindrical middle section built as a multiple-sided polygonal section that smoothly joins to a rounded bow and a tapered stern.

In one or more embodiments of the invention, the ultra-large marine submersible transport boat is built with its submersible hull having enough heavier-than-seawater material and the ballast chambers' volumes large enough, so that the controlled buoyancy of the ultra-large marine submersible transport boat with its submersible hull in a submerged position and with all its contained fluids in any operational status can, by ballasting, be controllably varied from an engineering specified negative value to an engineering specified positive value, and also so that engineering specified pitch and roll moments can be applied upon the ultra-large marine submersible transport boat in normal operational positions, by bow-to-stern and port-to-starboard differential ballasting, thus being possible to control the depth of the ultra-large marine submersible transport boat, and also its pitch, and the roll by controlled rotation around its transversal and longitudinal axes.

In one or more embodiments of the invention, the ultra-large marine submersible transport boat is built with its submersible hull provided with a multitude of hull openings through which the surrounding seawater circulates into and from the submersible hollow interior.

In one embodiment of the invention, the ultra-large marine submersible transport boat is built with its submersible hull provided with some hull openings that have some covers means that can be closed and also moved.

In one embodiment of the invention, the ultra-large marine submersible transport boat is built with its submersible hull having at least some of its hull openings positioned at the bow and some other hull openings positioned at the stern, the openings being at least partially unobturated during cruising and through which a continuous flow of seawater inside the submersible hull is established when the ultra-large marine submersible transport boat moves so that there is no long-range transportation of seawater contained inside of the submersible hull, as bulk ballast.

In one or more embodiments of the invention, the ultra-large marine submersible transport boat has its submersible hull's heavier-than seawater building material consisting mainly of reinforced concrete.

In one embodiment of the invention, the ultra-large marine submersible transport boat has the submersible hull further comprising a plurality of chamber reinforcements built inside its ballast chambers, between the outer shell and the inner shell, to sustain the loads from the pressure difference between the inside and outside of the ballast chambers and the shear loads appearing between the outer shell and the inner shell.

In one or more of the embodiments of the invention, the ultra-large marine submersible transport boat has its power generation groups and propulsion mechanisms positioned on-board and permanently fitted to the submersible hull.

In another embodiment of the invention, the ultra-large marine submersible transport boat has at least one of its power generation groups and propulsion mechanisms positioned on a separate tugboat that is attached to the submersible hull and pulls the ultra-large marine submersible transport boat with some tug lines.

In one embodiment of the invention, the ultra-large marine submersible transport boat has its on-board power generation groups of the internal combustion type that has its air intake through a snorkel tower that is positioned upon the submersible hull and has a hydrodynamic shape and height that allows the ultra-large marine submersible transport boat to navigate at engineering specified depths in complete submersible hull submersion while the power generation group has access to the atmospheric air through the air inlet built onto the snorkel tower.

In another embodiment of the invention, the ultra-large marine submersible transport boat has its onboard power generation groups built as an onboard nuclear power reactor.

In another embodiment of the invention, the ultra-large marine submersible transport boat has the on-board power generation groups consisting of an onboard group of batteries that are charged from shore while ultra-large marine submersible transport boat is moored for loading and unloading the bulk liquids, the onboard group of batteries driving the propulsion mechanisms while cruising.

In one or more embodiments of the invention, the ultra-large marine submersible comprises a plurality of hydroplanes steerably mounted to the submersible hull and acting as control surfaces.

In one or more embodiments of the invention the ultra-large marine submersible comprises a designated uppermost line upon the submersible hull, while in operation the submersible hull being controllably moved by ballasting so that the uppermost line is kept around the uppermost position of the ultra-large marine submersible transport boat with regard to the vertical, around the uppermost line being constructed a deck walkway on which, when at or above sea level, personnel and equipment access is permitted.

In one or more embodiments of the invention, the ultra-large marine submersible has its submersible hull's hollow interior cavity provided with a series of axially spaced apart radial reinforcing elements which oppose radial deformation of the submersible hull and are positioned so that they do not interfere with the displacement of the collapsible bladders while filled with and emptied of the bulk liquids.

In one embodiment of the invention, the ultra-large marine submersible transport boat is provided with an impervious command nacelle, mounted close to the upper side of a snorkel tower, the command nacelle being usually kept above the seawater during cruising, and hosting some of the electronics and some of the human interface of the ultra-large marine submersible transport boat.

An ultra-large marine submersible transportation supply arrangement used for supplying the bulk liquids to the ultra-large submersible transport boats is disclosed consisting of at least one of the ultra-large submersible transport boat and one specifically-built bulk liquids supply station erected in deep water adjacent to a seacoast that is close to at least one on-shore bulk liquid source the supply station hosting the ultra-large submersible transport boat, the supply station being provided with a supply pipeline terminated with at least one off-shore supply valve and with at least one bulk liquids supply connector that matches and is temporarily mated to the ultra-large marine submersible transport boats' bulk liquids transfer connectors. for the supply station to feed bulk liquids into the collapsible bladders of the ultra-large submersible boat.

Also, an ultra-large marine submersible transportation delivery arrangement used for delivering the bulk liquids from the ultra-large submersible transport boats is disclosed consisting of at least one of the ultra-large submersible transport boats and at least one specifically-built bulk liquids delivery station erected in deep water adjacent to a seacoast that is close to at least one on-shore bulk liquids user, the supply station hosting the ultra-large submersible transport boat.

the delivery station being provided with a delivery pipeline terminated with one off-shore delivery valve, and with one bulk liquids delivery connector that matches and is temporarily mated to the ultra-large marine submersible transport boats' bulk liquids transfer connectors, the delivery station being also provided with an inline delivery pump that feeds the delivery pipeline with the bulk liquids that is transferred from the collapsible bladders of the ultra-large submersible transport boat.

A method of loading large quantities of aqueous bulk liquids onto ultra-large marine submersible transportation boats using the supply arrangement is disclosed, this method of loading comprising:

the provision of the ultra-large marine submersible transportation supply arrangement and the implementation of the following operational phases:

a phase when the ultra-large marine submersible transport boat approaches the supply station for being filled with bulk liquids and is tugged into position adjacent to the supply station;

a phase when the ultra-large marine submersible transport boat is moored adjacent to the supply station;

a phase when the supply pipeline is brought into position onto the ultra-large marine submersible transport boat and the bulk liquids supply connector is mated to the bulk liquids transfer connector all connectors being uncapped, a phase when the ultra-large marine submersible transport boat is filled with bulk liquids by the following operational sub-phases:

(i) the transfer valves are opened;

(ii) the supply valve is opened;

(iii) the bulk liquid is transferred from the bulk liquid source through the supply pipeline into the collapsible bladders, (iv) during the filling of the collapsible bladders, the submersible hull is kept moored and is proportionally ballasted or deballasted as required, being kept at seawater level and in a horizontal and uppermost position by controllably introducing and removing hull ballast water into, respectively from, some of the ballast chambers;

a phase when the bulk liquids supply connector is unmated from the bulk liquids transfer connector that then is capped, a phase when the supply pipeline, together with the supply valve and supply connector, is moved away from the ultra-large marine submersible transport boat, a phase when the ultra-large marine submersible transport boat is un-moored and tugged away from the supply station.

A method of unloading large quantities of aqueous bulk liquids from ultra-large marine submersible transportation boats using the delivery arrangement is disclosed, the method of unloading comprising:

the provision of the ultra the large marine submersible transportation delivery arrangement and the implementation of the following operational phases:

a phase when the ultra-large marine submersible transport boat approaches the delivery station for delivering its bulk liquids and is tugged into position adjacent to the delivery station, a phase when the ultra-large marine submersible transport boat is moored adjacent to the delivery station, a phase when the delivery pipeline is brought into position onto the ultra-large marine submersible transport boat together with the delivery pump and the bulk liquids delivery connector is mated to the bulk liquids transfer connector all connectors being uncapped, a phase when the ultra-large marine submersible transport boat delivers its contained bulk liquids by the following operational sub-phases:

(i) the transfer valves are opened, (ii) the delivery valve is opened, (iii) the bulk liquid is transferred from the collapsible bladders to the user of the bulk liquid by simultaneously emptying the collapsible bladders with the delivery pump through the delivery pipeline, (iv) during the emptying of the collapsible bladders, the submersible hull is kept moored and is proportionally de-ballasted or ballasted as required, being kept at seawater level and in a horizontal and uppermost position by removing and introducing hull ballast water from, respectively into, some of the ballast chambers, a phase when the bulk liquids delivery connector is unmated from the bulk liquids transfer connector that then is capped, a phase when the delivery pipeline together with the delivery pump, the delivery valve, and the delivery connector, is moved away from the ultra-large marine submersible transport boat, a phase when the ultra-large marine submersible transport boat is un-moored and tugged away from the delivery station.

A method of transporting large quantities of aqueous bulk liquids with ultra-large marine submersible transportation boats is disclosed, the method of transporting comprising:

the provision of the ultra-large marine submersible boat and also the implementation of a travel period while the ultra-large marine submersible transport boat cruises on a route of choice, at speeds and depths of choice, while the ultra-large marine submersible transport boat is kept in a substantially uppermost and horizontal position and at controlled depths by ballasting of the ballast chambers.

A method of manufacturing of the ultra-large marine submersible transport boat's submersible hull is disclosed, the method of manufacturing comprising:

forming precast panels onshore, manufactured separately of each other in dry dock and left to cure, each precast panel containing at least one ballast chamber that makes it floatable, the precast panels, being engineered to construct the submersible hull by their assembling.

putting the cured precast panel in flotation and towing them while floating to a marine assembling yard in the seawater at least as deep as the maximum transversal diameter of the submersible hull, assembling the precast panels to each other to form the submersible hull in the marine assembly yard.

A detailing of the previously described method of manufacturing is disclosed, the method of manufacturing further involving that the precast panels before being attached to each other, are pulled above the water onto an assembling floating platform that is provided with support rollers that can be substantially aligned with the curved surface of the inner shell of the submersible hull to be built, the precast panels being assembled to each other and their inter-panel gap being filled with an assembly seam that is poured in place so that larger multi-panel annular sections are built, the multi-panel annular sections at their turn being coaxially assembled to each other to form the complete submersible hull. the submersible hull having some hull openings enabling the assembling floating platforms caught inside the submersible hull's hollow interior cavity to be disassembled into smaller pieces and extracted from the assembled submersible hull through its hull openings.

DETAILED DESCRIPTION

Figure 1:
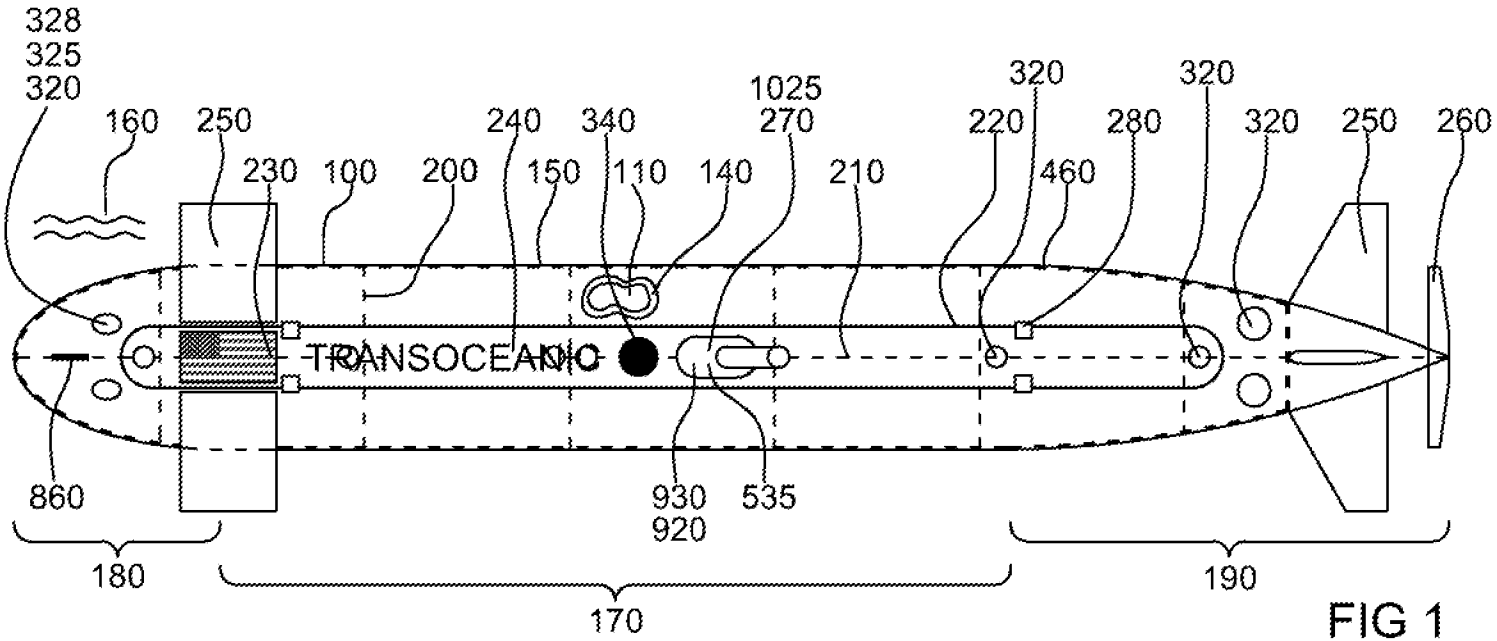
FIG. 1 Top view of an ultra-large marine submersible transport boat for bulk liquids with a small part of its submersible hull and a small part of one of its collapsible bladders represented as being removed to show the collapsible bladder and the transported bulk liquid.
Figure 2:
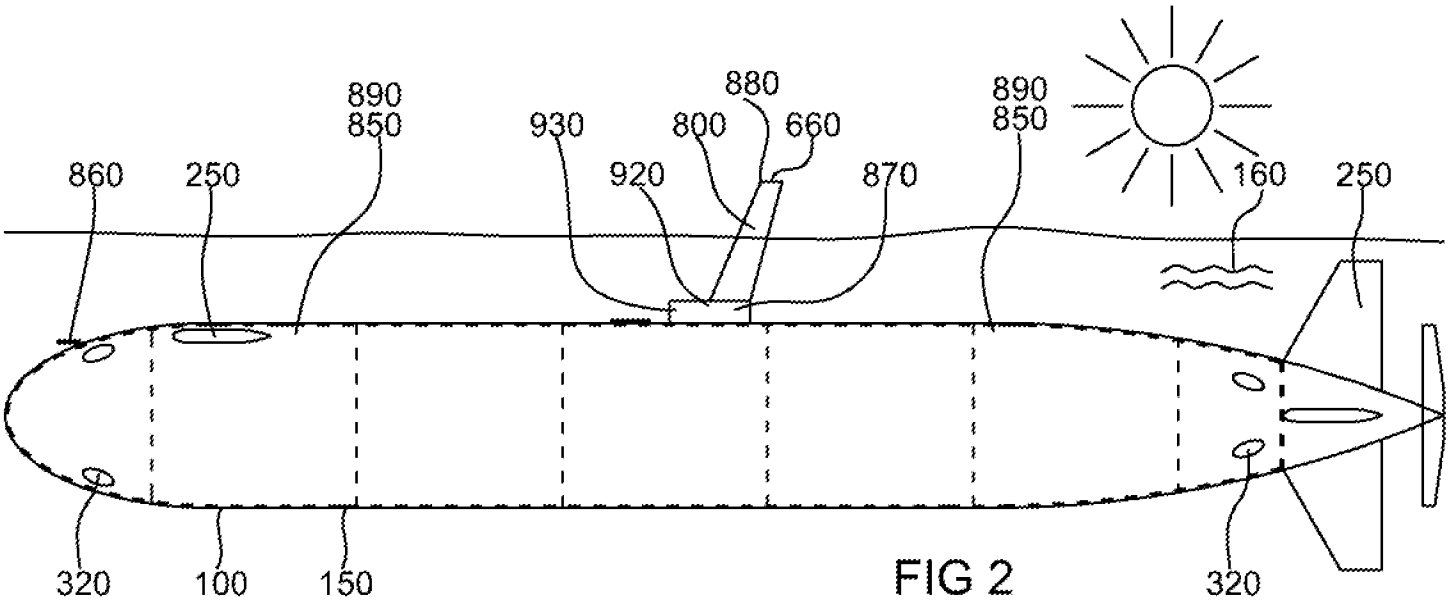
FIG. 2 Side view of an ultra-large marine submersible transport boat for bulk liquids while cruising under the ocean surface.
Figure 7:
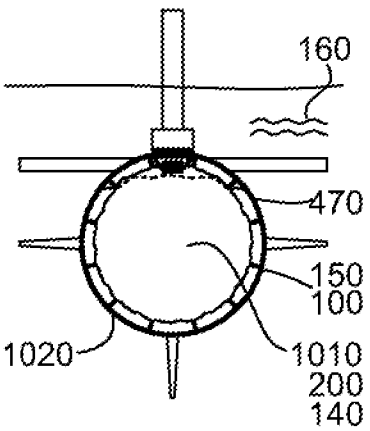
FIG. 7 Transversal cross-section through an ultra-large marine submersible transport boat for bulk liquids with reinforcing elements built as a face of the collapsible bladder attached in tension to the submersible hull with some reinforcement attachments.
Figure 6:
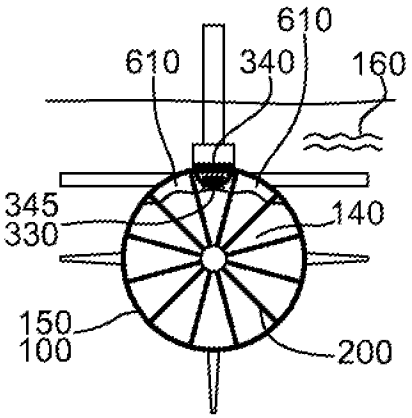
FIG. 6 Transversal cross-section through an ultra-large marine submersible transport boat for bulk liquids with reinforcing elements built as tension strings.
Figure 3:
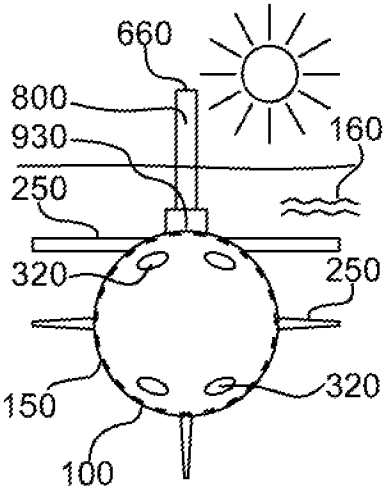
FIG. 3 Front view of an ultra-large marine submersible transport boat for bulk liquids cruising under the ocean surface.
Figure 4:
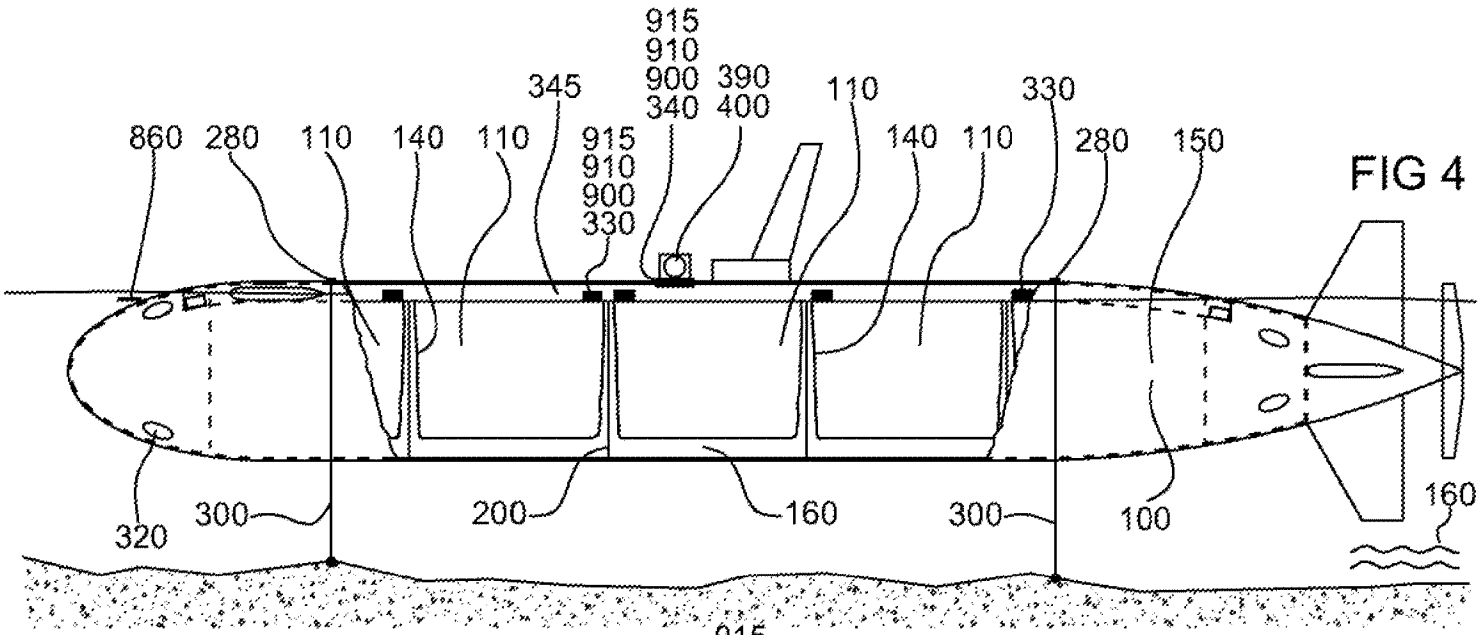
FIG. 4 Partial longitudinal section through a moored ultra-large marine submersible transport boat for bulk liquids with separate multiple impervious collapsible bladders while being filled with the bulk liquid, showing some of the reinforcing elements.
Figure 5:
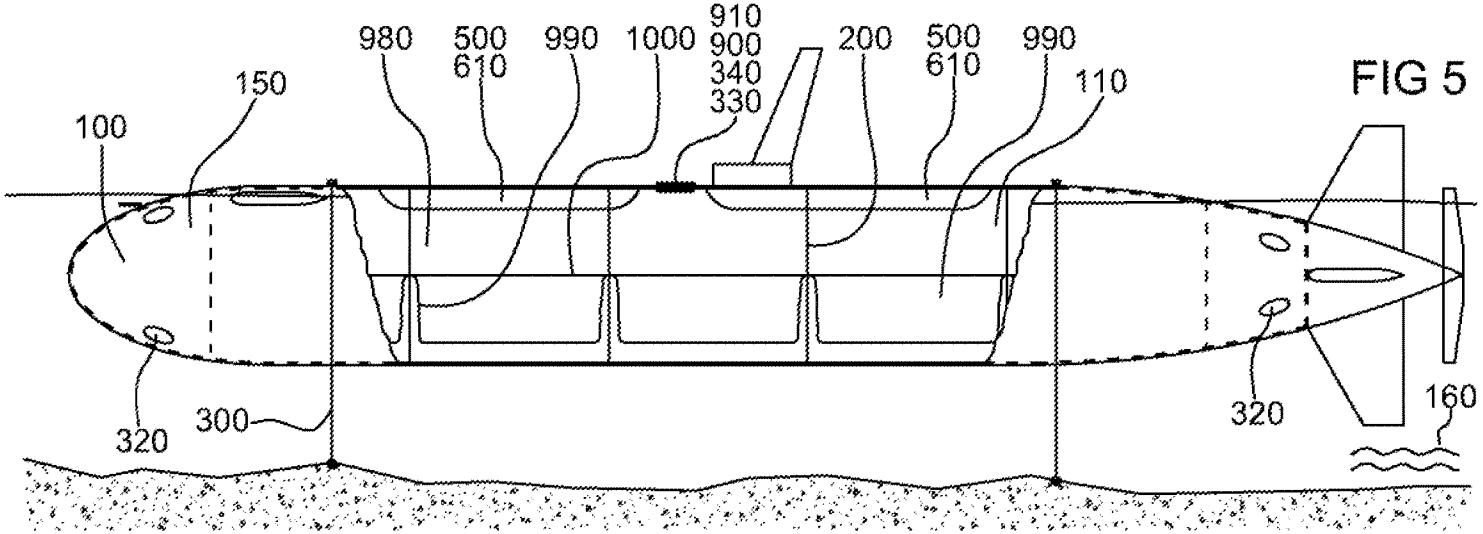
FIG. 5 Partial longitudinal section through a moored ultra-large marine submersible transport boat for bulk liquids with the impervious collapsible bladder formed by a longitudinal flexible and impervious membrane together with the superior part of the submersible hull.
Figure 8:
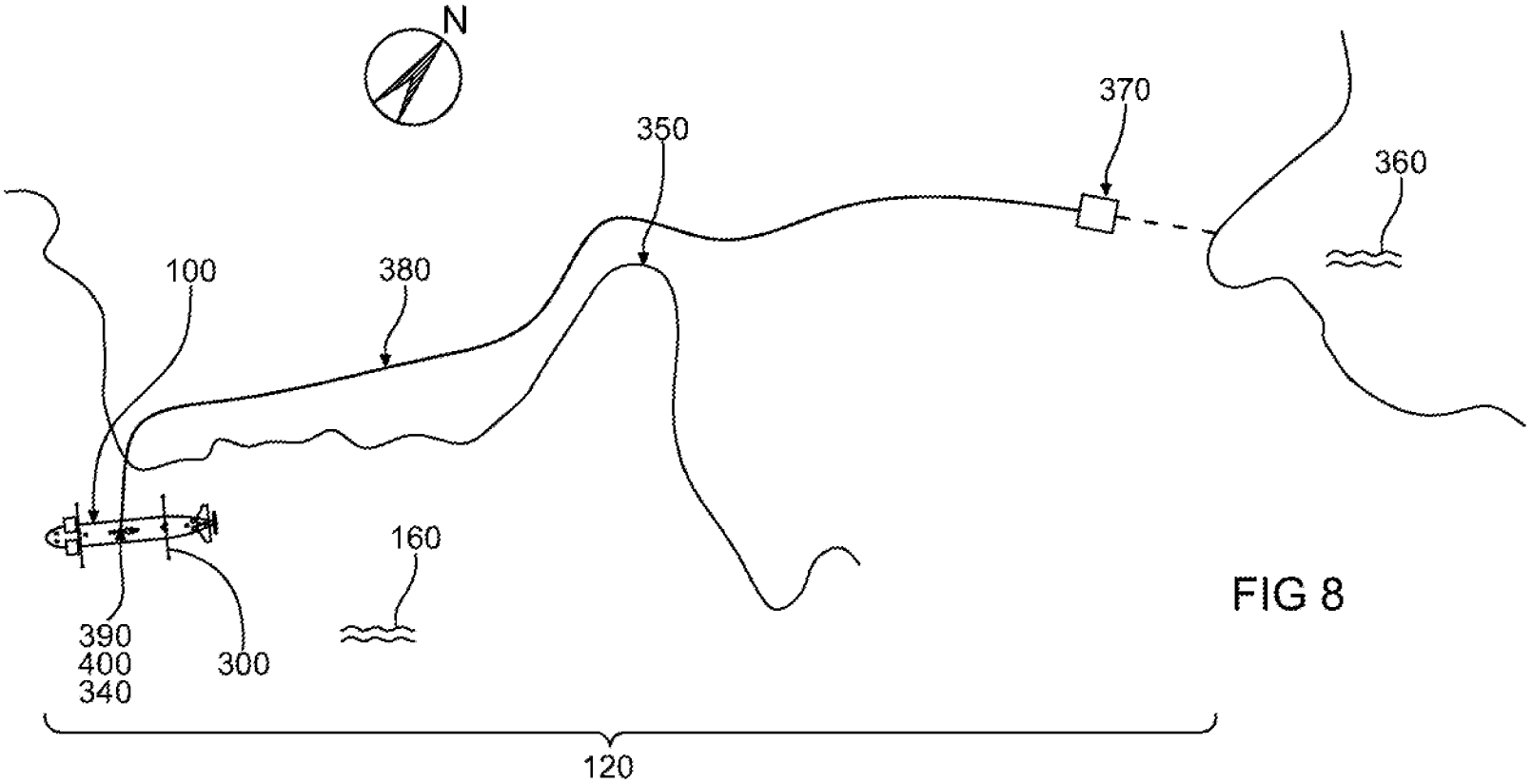
FIG. 8 General view of a supply arrangement while loading a moored ultra-large marine submersible transport boat with bulk liquid at a supply station.
Figure 9:
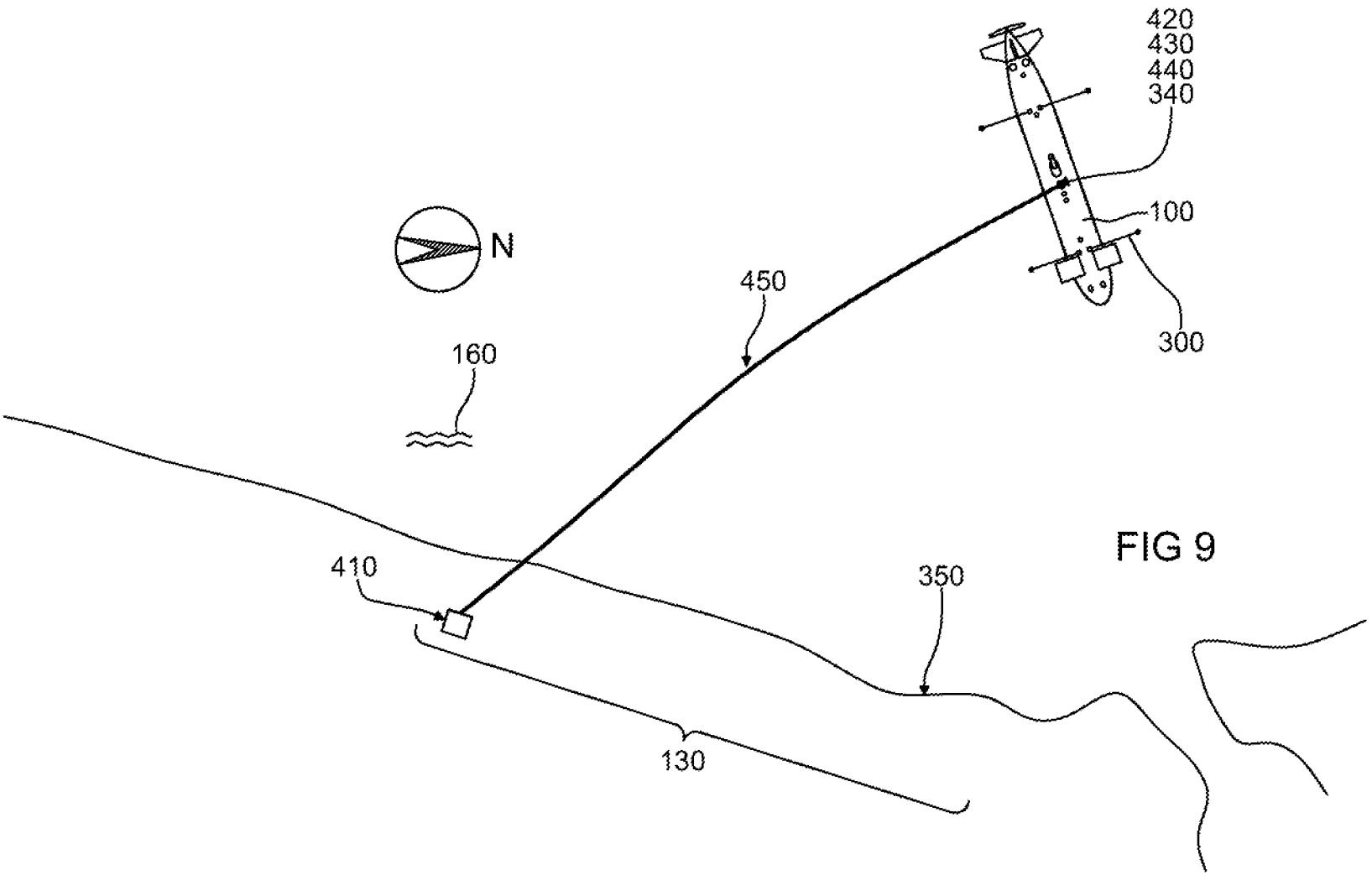
FIG. 9 General view of a delivery arrangement while unloading the bulk liquid from a moored ultra-large marine submersible transport boat at a delivery station.
Figure 11:
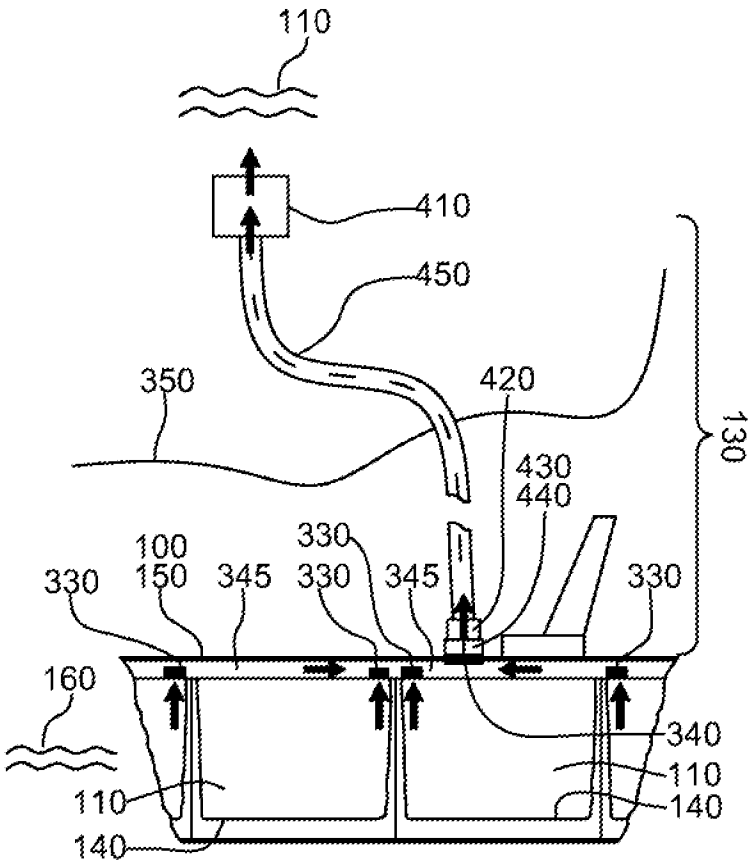
Figure 10:
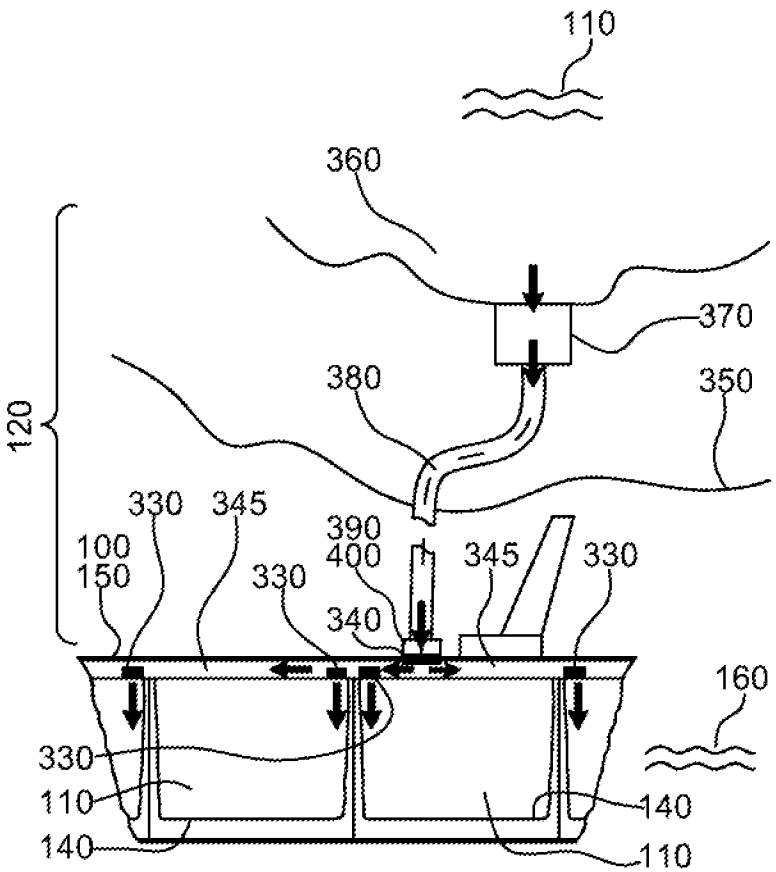
FIG. 10 Schematic of bulk liquid transfer connections while loading the bulk liquid into an ultra-large marine submersible transport boat at a supply station with arrows showing the bulk liquid flow direction FIG. 11 Schematic of bulk liquid transfer connections while unloading the bulk liquid from an ultra-large marine submersible transport boat at the delivery station with arrows showing the bulk liquid flow direction.
Figure 12:
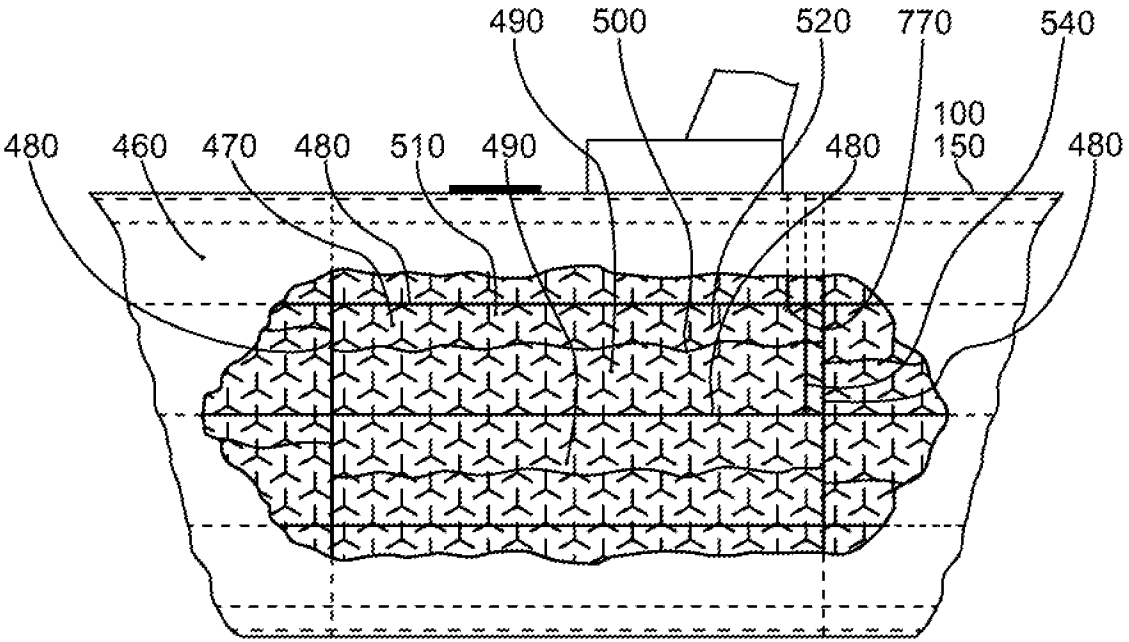
FIG. 12 Ultra-large marine submersible transport boat's ballast chamber arrangement into the submersible hull with its outer shell represented partially removed, with the chamber reinforcements visible and with typical ballast water pipe and typical ballast air duct marked.
Figure 13:
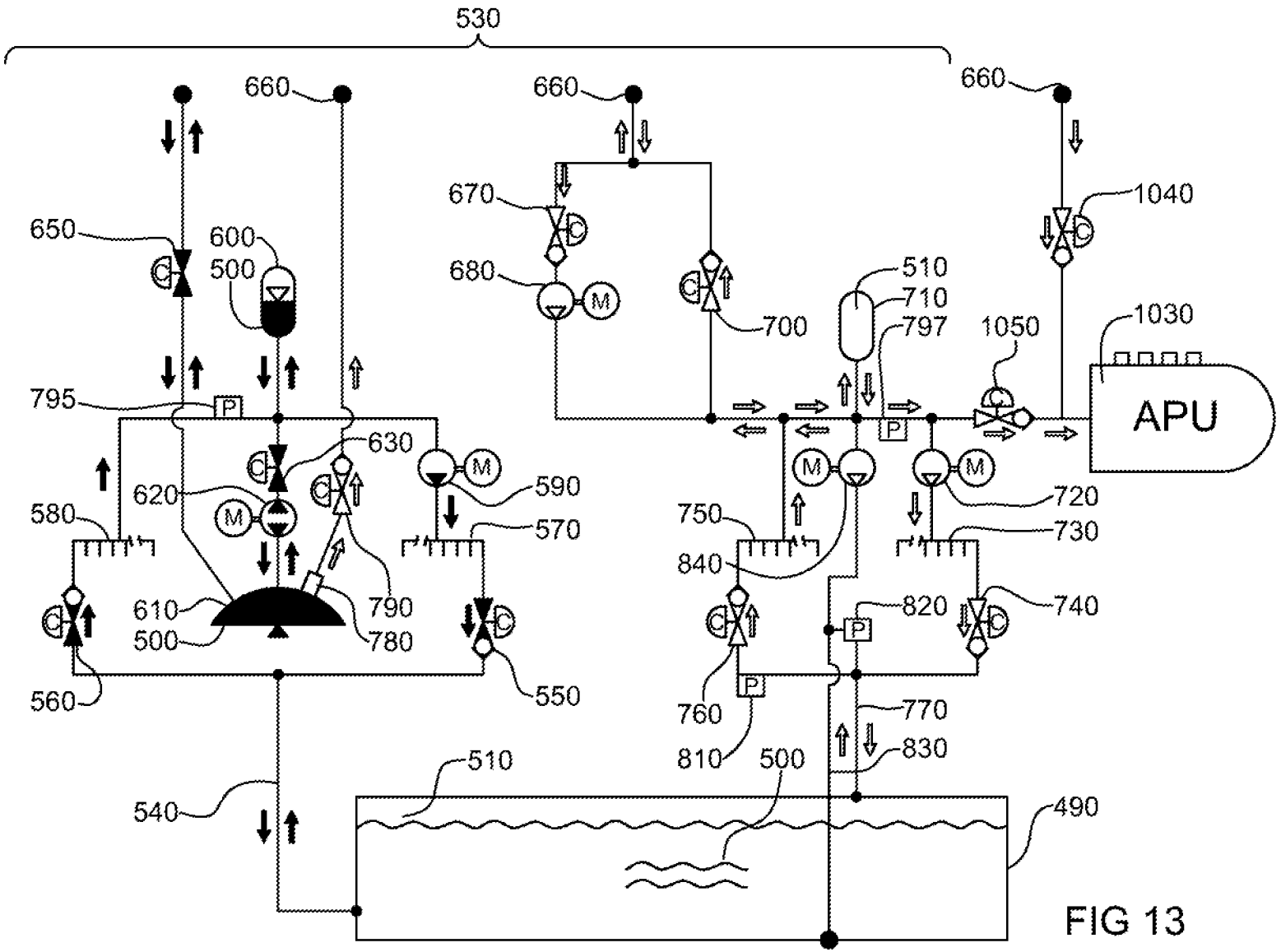
FIG. 13 Schematics of the hydro-pneumatic hull ballast water and ballast air installations with arrows showing the typical flow of hull ballast water and air for one ballast chamber, and the emergency feed of ballast air for the auxiliary power unit.
Figure 14:
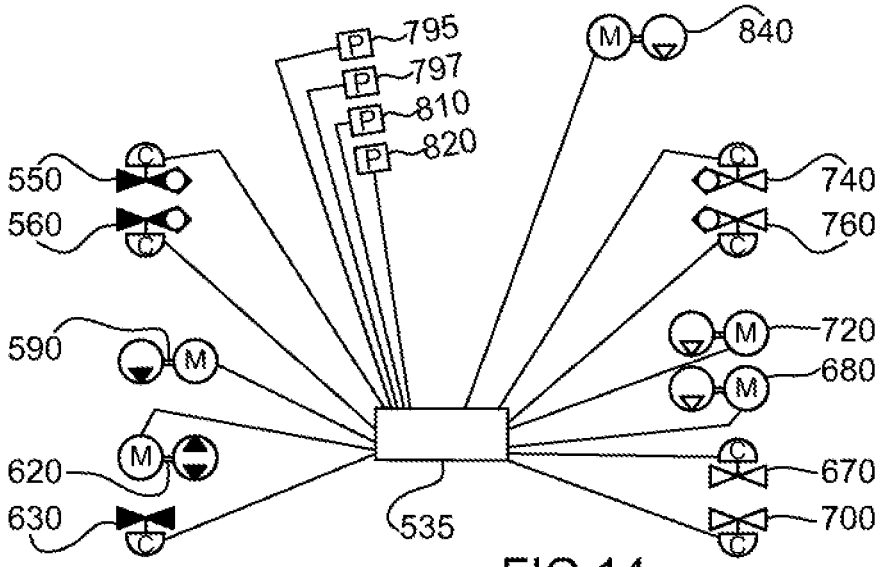
FIG. 14 Schematic of the ballasting command and control center connections to the controllable components of the hydro-pneumatic ballasting system.
Figure 15:
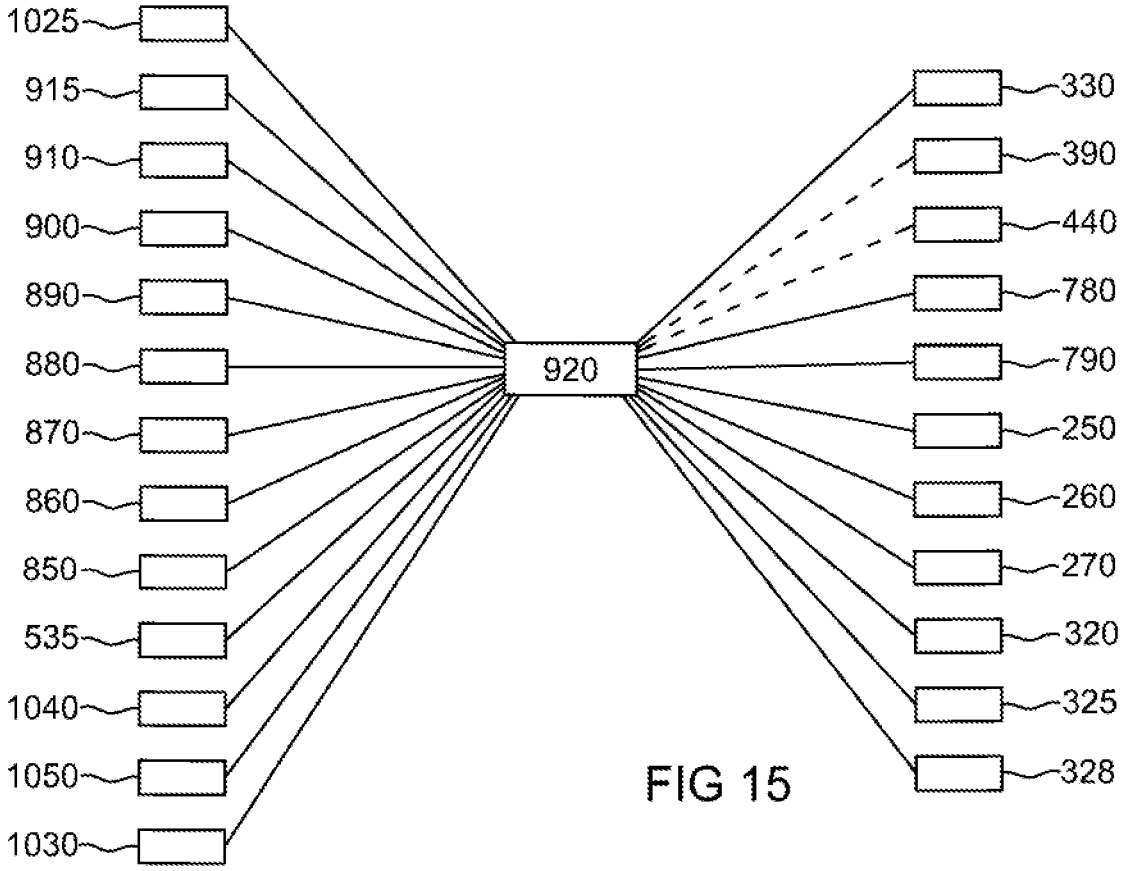
FIG. 15 Schematic of the general command and control center connections to the data delivering and controllable components of an ultra-large marine submersible transport boat.
Figure 16:
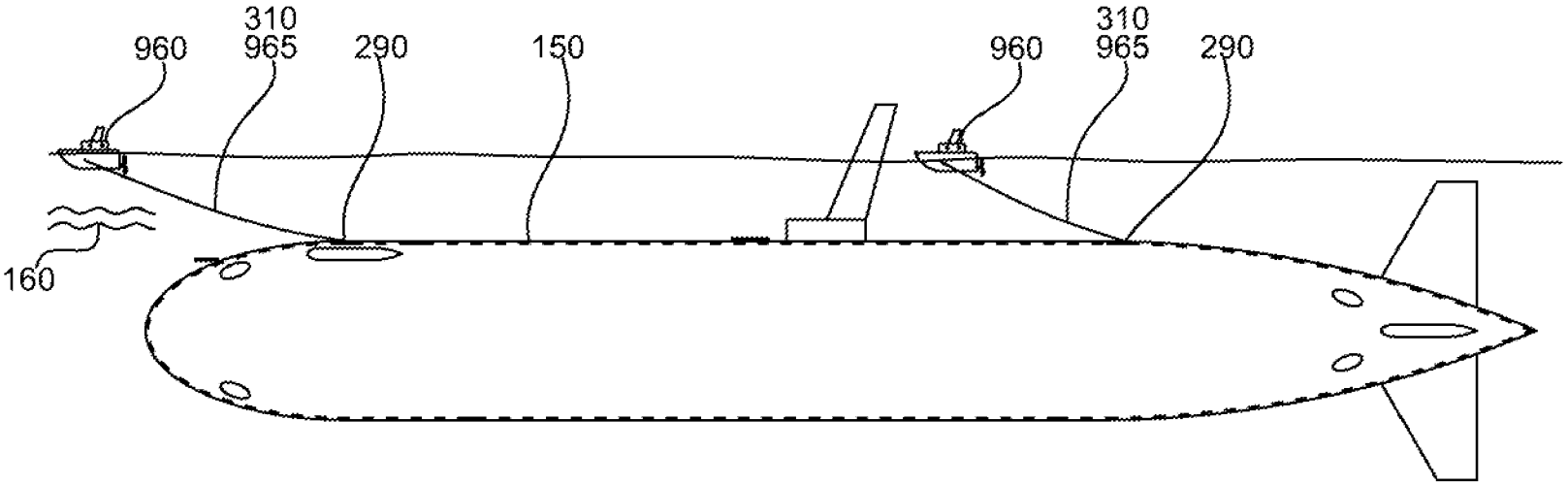
FIG. 16 Side view of an ultra-large marine submersible transport boat being pulled with tugboats and tug lines on which electric power lines are provided for the ultra-large marine submersible transport boat power supply.
Figure 18:
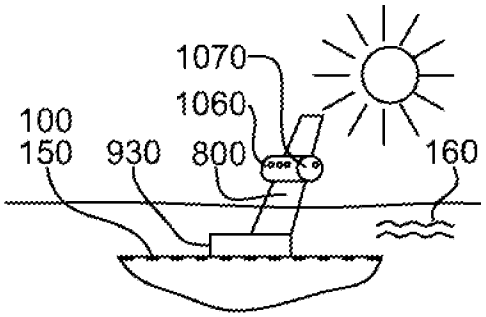
Figure 17:
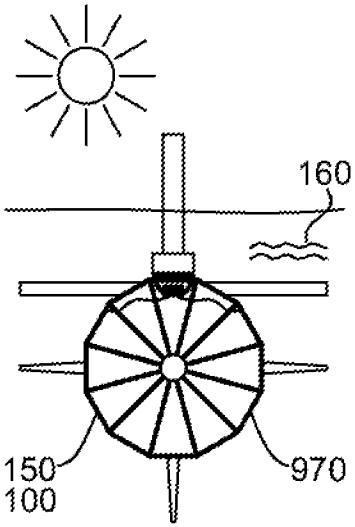
FIG. 17 Detail of a transversal section through a polygonal submersible hull FIG. 18 Side view detail of an ultra-large marine submersible transport boat built with an impervious command nacelle fitted at the upper end of a snorkel tower.
Figure 19:
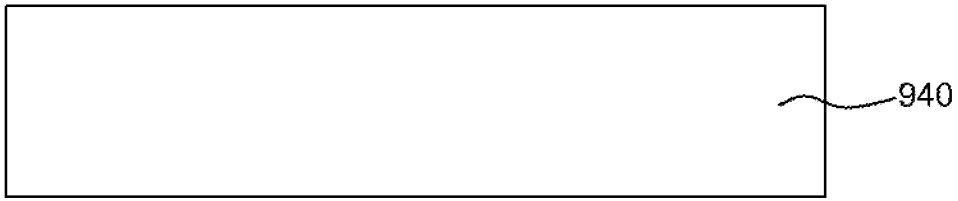
FIG. 19 Top view of a precast panel before being assembled into the submersible hull.
Figure 20:
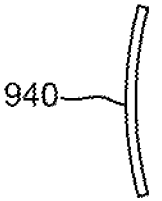
FIG. 20 Front view of a precast panel before being assembled into the submersible hull.
Figure 21:
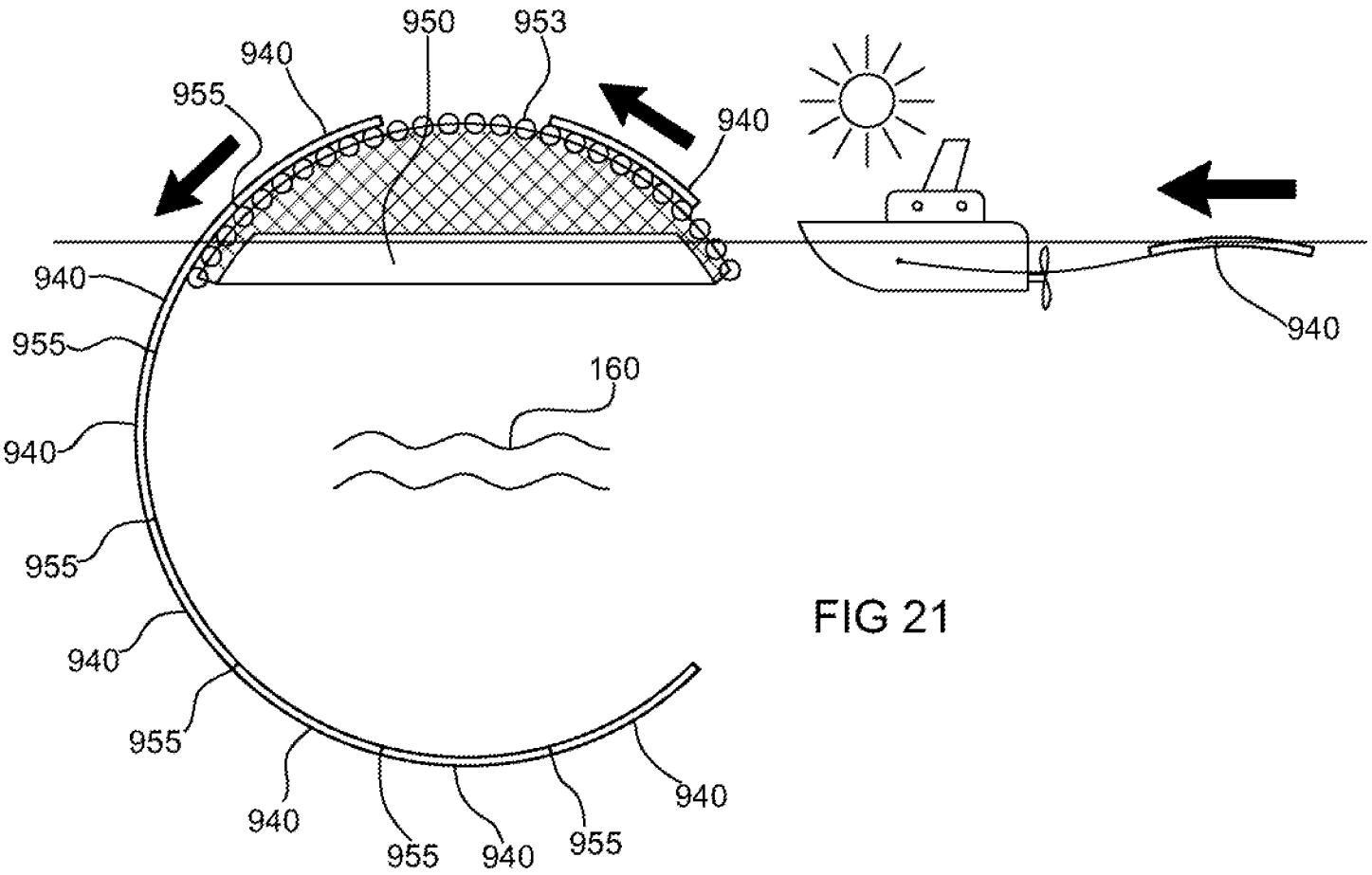
FIG. 21 View on an off-shore manufacturing site while assembling precast panels to form a section of the submersible hull with arrows showing the direction of controlled movement of the precast panels before and after assembling.
Figure 22:
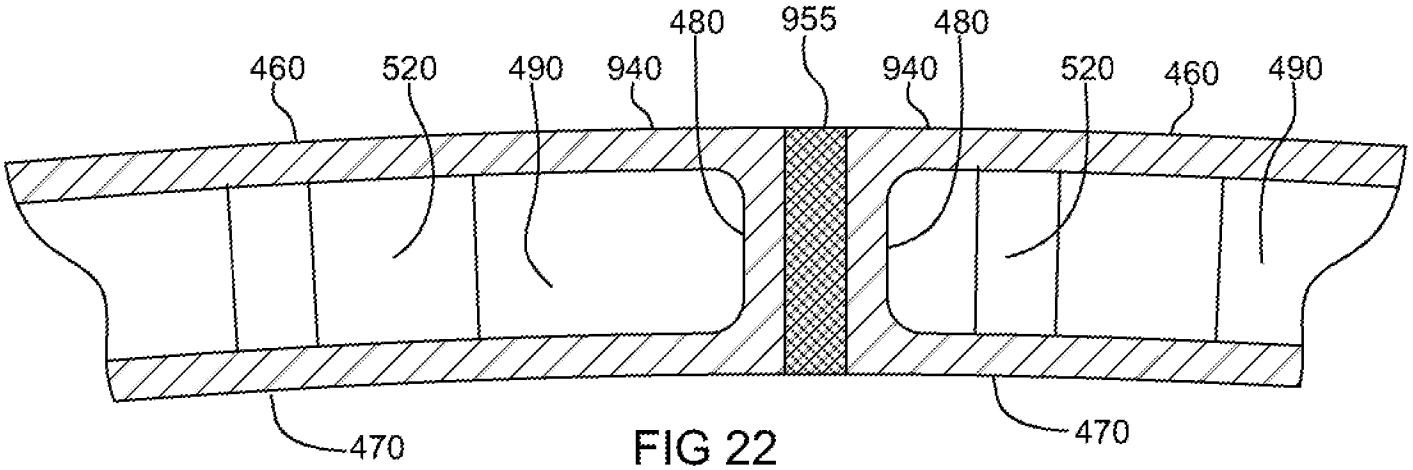
FIG. 22A detailed section of a submersible hull through two joint precast panels showing the assembly seam.

The drawings of the present invention show one ultra-large marine submersible transport boat(100) built to be loaded with aqueous bulk liquids(110) from at least one compatible specifically-built supply station(120) and to carry them across the oceans and seas to at least one compatible specifically-built delivery station(130) where the bulk liquids(110) are unloaded.

The ultra-large submersible transport boat(100) alone, or in conjunction with other similar ultra-large submersible transport boats(100), together with some compatible supply stations(120) and some compatible delivery stations(130), form an ultra-large marine submersible transportation system for which methods for loading, transporting, and delivering of large quantities of bulk liquids are described hereafter.

Fresh water is the main aqueous bulk liquids to be transported with the ultra-large marine submersible transport boats(100) per the present invention, and all the items built into the ultra-large marine submersible transport boat(100), that are in contact with the fresh water are compatible with fresh water as a transported bulk liquid and are built to keep its quality.

The ultra-large marine submersible transport boats(100) are very large structures similar to submarines, typically of lengths of over 400 meters up to 2400 meters (1312 to 7874 ft) with a typical length to maximum transversal dimension ratio of 6 to 9, meaning diameters of 45 meters to 400 meters (148 to 1312 ft), for minimizing the drag per transportation capacity, and with bulk liquids capacity of over 550 000 DWT, making them larger than most of the existing ship including the ULCCs according to AFRA scale, and reaching typical capacities of over 120 million cubic meters (over 100,000 acre-feet), thus defining a new class of transportation ships called ULMS (Ultra-Large Marine Submersible)

The reason for choosing a submersible configuration for the ultra-large marine submersible transport boat(100) is that the ultra-large marine submersible transport boat(100) while in submersion is subject to milder environmental and mechanical solicitations than a floating surface ship. The ultra-large marine submersible transport boat(100) also presents reduced drag when cruising in submersion, and with the hereafter described construction the submersion pressures can be successfully sustained.

The ultra-large marine submersible transport boat(100) can also be built with smaller overall dimensions but the transportation becomes less economical and might be used mainly for specialized tasks, like transboarding to interface between the larger submersible transport boats(100) and the shallow water positions of certain supply stations(120), respectively delivery stations(130).

However, some different bulk liquid cargos might require smaller submersible transport boats(100), while other fresh water transport applications can be designed with larger dimensions of the submersible transport boats(100).

Also, although very economical at very large dimensions, the ultra-large marine submersible transport boats(100) are then restricted in approaching the shallow waters; thus, the supply stations(120) and delivery stations(130) need to be far positioned off-shore and difficult to build and operate or the bulk liquids loading and unloading require transboarding.

Each ultra-large marine submersible transport boat(100) according to the present invention consists of some impervious collapsible bladders(140) used to receive bulk liquids (110) for transportation, enclosed inside a controllable-ballasted rigid and hollow submersible hull(150) built from heavier-than-seawater materials, like reinforced concrete the submersible hull(150) being immersed in seawater(160) and built as an elongate hydrodynamic shape that has a longitudinally smooth exterior, and that is formed of a cylindrical middle section(170) terminated by a rounded bow(180) and a tapered stern (190), the submersible hull being substantially circular in its transversal sections.

The preferred hydrodynamic shape for the submersible hull(150) is that of a Defense Research Establishment Atlantic (DREA) submarine hull.

The shape of the submersible hull(150) is optimized for minimum hydrodynamic drag, also taking into account the manufacturing and cost limitations.

In other variants of the invention, the submersible hull (150) has other hydrodynamic shapes different from a DREA hull.

The reason for using a circular section for the submersible hull(150) is that, as mathematically proven, if a thin-shelled section with a fixed-length perimeter floats in seawater being filled with a liquid at slightly positive pressure and being uniformly ballasted or uniformly buoyant on its contour so that the weight of the contained liquid plus the ballast weight or buoyancy offered by the thin-shelled section is equal to the weight of the displaced seawater, then the thin-shelled section stays circular when in static mechanical equilibrium, and presents only tensile stress and no buckling.

However, in other constructive configurations the submersible hulls(150) are built with other streamlined shapes, some with no cylindrical section and with transversal sections that are different from circular, like elliptical sections that might be preferred for operation in shallower water.

The reason for using reinforced concrete for the building of the submersible hull(150) is the necessity for an economical sturdy and corrosion-resistant structure that is easy to maintain and also can provide distributed ballasting when transporting liquids lighter than seawater(160).

Thus, the ultra-large marine submersible transport boat (100) in the main configuration of the invention is built as a sturdy thin-shelled reinforced concrete circular section structure that can be substantially uniform-ballasted on its perimeter, and that is with preponderance subject to tension loads.

Other diverse solicitations and conditions during manufacturing and operation exist and are successfully supported by the structure of the submersible hull(150) as depicted hereafter.

The rigid submersible hull(150) maintains its stable shape during the operation of the ultra-large marine submersible transport boat(100) while sheltering the contained collapsible bladders(140) that at their turn separate and hold the bulk liquids(110) in their impervious enclosure.

The submersible hull(150) is provided some inside reinforcing elements(200) that are working in tension with the purpose of increase the radial rigidity of the submersible hull(150), and that oppose the submersible hull(150) radial deformation by being connected to substantially diametrically opposite locations onto the inside the submersible hull(150) and that do not interfere with the collapsible bladders(140) while the collapsible bladders(140) are filled with, or emptied of bulk liquids(110).

The submersible hull(150) has one of its longitudinal exterior line designated by engineering as an uppermost line(210) that is kept in an uppermost position by ballasting, and is provided with a deck walkway(220) positioned on both sides of the uppermost line(210), and configured as a marked longitudinal area on the submersible hull(150) in the proximity of which most of the ultra-large marine submersible transport boat's(100) equipment and access points are positioned, and where personnel and work equipment access is permitted when the deck walkway(220) is stationary at or above the sea level.

The vertical for the ultra-large marine submersible transport boat(100) is defined with the uppermost line(210) held in the uppermost position and its longitudinal axis substantially horizontal. This position is also defined as the uppermost position for the ultra-large marine submersible transport boat(100).

The ultra-large marine submersible transport boat(100) is marked on its outer surface with its country of registration flag(230) and with its assigned name(240).

The ultra-large marine submersible transport boat(100) is provided with some angle-controlled hydroplanes(250) that act as control surfaces and are steerably mounted onto the submersible hull(150).

The ultra-large marine submersible transport boat(100) is also provided with at least one propulsion mechanism(260) and at least one on-board power generation group(270) that delivers the required energy to the propulsion mechanism (260) and to all other onboard hardware requiring energy so that the ultra-large marine submersible transport boat(100) can be operated, maneuvered, and can navigate. The on-board power generation groups(270) can be of the internal combustion type or onboard nuclear power reactors.

The ultra-large marine submersible transport boat(100) is also provided with some chocks(280) and some towing pads(290) assembled on the outside of its submersible hull(150), to which some mooring lines(300) respectively some tug lines(310) are attached, as required.

The collapsible bladders(140) are built to be filled with bulk liquids(110) at one of the supply stations(120) while increasing their content volume, and to be, while collapsing, emptied of the bulk liquids(110) at one of the delivery stations(130), and they are shaped to substantially occupy almost the whole free hollow inside of the reinforced concrete submersible hull(150) when filled with bulk liquids (110).

The submersible hull(150) is provided with some hull openings(320) connecting the interior cavity of the submersible hull(150) with the surrounding open sea, and through which the seawater(160) replaces or is expelled when the bulk liquids(110) moves in respectively out from the collapsible bladders(140), or through which a continuous flow of seawater(160) inside the submersible hull(150) is established from bow to stern when the ultra-large marine submersible transport boat(100) moves, and also through which pressure equalization between the inside and outside of the submersible hull(150), as well as access to internal parts and venting of the submersible hull(150), is ensured.

The continuous flow of seawater(160) inside the moving submersible hull(150) through the hull openings(320) that are positioned at the bow and stern, is produced mainly by the dynamic pressure of the seawater(160), and the continuous flow speed is engineered so that there is no long-range transportation of seawater(160) contained inside of the submersible hull(150) as bulk ballast, mainly while returning with the collapsible bladders(140) empty of bulk liquids from a delivery station(130) but also for the case of traveling with a full load of bulk liquids(110), thus the environmentally bothersome and costly dumping of the bulk ballast seawater after long-distance transportation being unnecessary. The internal continuous flow of seawater(160) is designed to take place when the collapsible bladders(140) are empty, as well as full, although, when the collapsible bladders are full of bulk liquids(110), there is only a minimal quantity of seawater inside the submersible hull(150) to be transported.

The hull openings(320) are positioned and dimensioned per their functionality. The hull openings(320) at bow and stern are designed for the continuous flow of seawater(160) through the submersible hull(150) and have total sections of hundreds of square meters (thousands of square feet) while the hull openings(320) positioned on the upper side of the submersible hull(150) are assigned for access and venting and are smaller.

Some of the hull openings(320) are partially closable being provided with some hull openings covers(325), like hatches or other mechanical means, and are controllably and partially closed when the submersible hull(150) is filled with bulk liquids(110) ready for transportation, so that the collapsible bladders(140) shape is not adversely affected by the seawater dynamic pressure when the ultra-large marine submersible transport boat(100) moves, but at the same time the continuous circulation of the seawater(160) is not stopped and there is substantially no seawater(160) transported at large distances.

Some of its hull openings(320) are provided with at least one electrically driven seawater circulation propeller(328) that increases the seawater(160) continuous change inside the submersible hull(150)

For filling and emptying, each collapsible bladder(140) is provided on its upper part with at least one onboard bulk liquids transfer valve(330) that allows the transfer of bulk liquids(110) when open, and, when closed, isolates the bulk liquids collapsible bladders(140).

The bulk liquids transfer valves(330) are connected to the supply stations(120) and the delivery stations(130) through a closed bulk liquids transfer canal(345) built under the upper part of the submersible hull(150) and interconnecting all the bulk liquids transfer valve(330), and through an external on-board bulk liquids transfer connector(340) positioned on the deck walkway(220) and communicating with the transfer canal(345).

The bulk liquids transfer canal(345) can miss when just a single collapsible bladder(140) is provided on the ultra-large marine submersible transport boat(100), the transfer valve (330) for the sole collapsible bladder(140) being positioned directly on the submersible hull(150) adjacent and connected to the external onboard bulk liquids transfer connector(340).

The bulk liquids transfer canal(345) is also missing when each of the collapsible bladder(140) is provided with an independent transfer valve(330) that is positioned directly on the submersible hull(150), adjacent and connected to an independent external onboard bulk liquids transfer connector(340), this configuration not being depicted on the drawings.

The bulk liquids transfer connectors(340) are capped by some impervious cap when transfers of bulk liquids(110) are not performed.

The ultra-large marine submersible transport boats(100) in normal use according to the present invention do not need to get any means for the compensation of expansion of the contained fluids because of their very large quantities; however, the de-aeration of contained fluids is done as required.

The supply stations(120) are erected in sheltered deep water adjacent to sea coasts(350) that are close to at least one on-shore bulk liquid source(360), each of the supply stations (120), for filling the empty ultra-large marine submersible transport boats(100) temporarily hosted and moored in a floating state at the supply station(120), is provided with at least one supply pumping station(370) that receives the available bulk liquids(110) from the bulk liquid source(360), and supplies it through a supply pipeline(380) terminated with at least one off-shore supply valve(390) and with at least one bulk liquids supply connector(400) that are sequentially mounted upon the hosted ultra-large marine submersible transport boats(100) and connected to their bulk liquids transfer connectors(340), with which the bulk liquids supply connector(400) is mechanically compatible, and subsequently the supply station(120) fills the accessed collapsible bladders(140) with bulk liquids(110) through the opened transfer valves(330) and the bulk liquids transfer canal(345) if provided.

The supply pumping station(370) might miss if the bulk liquids are already delivered under pressure from the bulk liquid source(360) that, in the case of fresh water as a bulk liquid, can be a lake located at an altitude higher than the sea level.

The delivery stations(130) are erected in sheltered deep water near sea coasts(350), adjacent to at least one on-shore bulk liquids user(410), each of the delivery stations(130), for unloading the ultra-large marine submersible transport boats (100) temporarily stationed and moored in a floating state at the delivery station(130), is provided with at least one off-shore delivery pump(420) and at least one off-shore delivery valve(430) coupled with at least one bulk liquids delivery connector (440), that are sequentially mounted for bulk liquids extraction upon the hosted ultra-large marine submersible transport boats(100) and connects to their bulk liquids transfer connectors(340) with which the bulk liquids delivery connector(440) is mechanically compatible, the off-shore delivery pump(420) unloading the bulk liquids (110) from the accessed collapsible bladders(140) through the opened transfer valves(330) and delivering it to the bulk liquids user(410) through a delivery pipeline(450).

For longer supply pipelines(380) or delivery pipelines (450), multiple boosting supply pumping stations(370), respectively multiple boosting delivery pumps(420), might be required along the pipelines.

If the bulk liquid(110) is fresh water, then there is a positive pressure at the level of the bulk liquids transfer connectors(340) when the submersible hull(150) floats at, or under, the sea level.

For bulk liquids(110) heavier than seawater(160) the unloading procedure will take into account that there is no positive pressure at the level of the bulk liquids transfer connectors(340) and the bulk liquids(110) might need to be extracted from the collapsible bladders(140).

In the areas with no hull openings(320), the submersible hull(150) is built with an outer shell(460) and an inner shell(470) joined by some separating partitions(480), together forming a multitude of separate impervious ballast chambers(490) that are controllably ballasted independently of each other by partially and controllably filling them with some hull ballast water(500) and de-ballasted by the elimination of at least some of the contained hull ballast water (500), the ballast chambers' volume not occupied by hull ballast water(500) being occupied by some ballast air(510).

Thus, the pitch and roll angles, the depth of the ultra-large marine submersible transport boat(100), as well as the stresses in the submersible hull(150), are controlled by adjusting the ballasting provided by the hull ballast water (500) and the pressure of the ballast air(510) in each ballast chamber(490).

Some chamber reinforcements(520) are built inside the ballast chambers(490), between the outer shell(460) and the inner shell(470), so that the loads from the pressure difference between the inside and outside of the ballast chambers (490) and the shear loads appearing between the outer shell(460) and the inner shell(470) are sustained.

The chamber reinforcements(520) are built as short columns or short interior walls and the chamber reinforcement arrangement should not hamper the mobility of the hull ballast water(500) or the ballast air(510) contained inside each of the ballast chambers(490) and should be optimally sized and easy to manufacture.

The ultra-large marine submersible transport boat(100) has its submersible hull(150) built with enough heavier-than-seawater material and with large enough volumes of the ballast chambers(490) so that the controlled buoyancy of the ultra-large marine submersible transport boat(100) with its submersible hull(150) submerged and with all its contained fluids in any operational status can by ballasting be varied from an engineering specified negative value to an engineering specified positive value, and also so that the pitch and roll moments can be applied upon the ultra-large marine submersible transport boat(100) in normal operational position by differential ballasting, thus being possible to control the depth, the pitch, and the roll of the ultra-large marine submersible transport boat(100).

The requirement described above means (i) that the ultra-large marine submersible transport boat(100) has its submersible hull(150) built with enough heavier-than seawater material so that the ultra-large marine submersible transport boat(100) presents negative buoyancy and can move deeper and be completely submerged, at any status of fill of the collapsible bladders(140) with any accepted bulk liquids(110) when the ballast chambers(490) are fully ballasted with hull ballast water(500), and (ii) that the ultra-large marine submersible transport boat(100) has its submersible hull(150) provided with ballast chambers(490) built with internal volumes large enough so that the ultra-large marine submersible transport boat(100) presents a positive buoyancy and can decrease its depth and partially float above the surface of the sea in any status of fill of the collapsible bladders(140) with any acceptable bulk liquids (110) when the ballast chambers(490) are fully de-ballasted of hull ballast water(500), and also (iii) that the ultra-large marine submersible transport boat(100) can be controllably rotated around the longitudinal and transversal axes by differentially modifying the ballasting into the ballasting chambers(490) on opposed front and back respectively left and right sides of the submersible hull(150).

For ballasting and de-ballasting the ultra-large marine submersible transport boat(100) is built with at least one on-board hydro-pneumatic ballasting system(530) that controllably feeds and extract hull ballast water(500), as well as ballast air(510), into and from the ballast chambers(490), and is also provided with some ballasting command and control center (535) that commands and controls all active components of the hydro-pneumatic ballasting system(530) like pumps, compressors, and valves, receiving the pressure information from pressure sensors, as shown below.

The hydro-pneumatic ballasting system(530) is provided some ballast water pipes(540), some controllable ballast water admission check valves(550), some controllable ballast water evacuation check valves(560), at least one ballast water admission distributor(570), at least one ballast water evacuation distributor(580), at least one ballast water admission pump(590), at least one ballast water accumulator(600), at least one impervious collapsible hull ballast water storage bag(610), at least one ballast water storage bidirectional pump(620) in line with a controllable storage bidirectional valve(630), and at least one ballast water access point(640) through which the hull ballast water(500) is introduced from or extracted to the exterior of the ultra-large marine submersible transport boat(100) employing a controllable bidirectional ballast water access valve(650), and is also provided with at least one atmospheric air connection(660) connected to at least one controllable atmospheric ballast air admission valve(670), at least one atmospheric air compressor(680) that is connected to at least one ballast air accumulator(710), at its turn connected to the inlet of at least one ballast air compressor(720) feeding at least one multiport air admission tee(730) connected to some controllable compressed ballast air valves(740) delivering the ballast air(510) to each of some ballast air ducts(770), the release of the ballast air(510) being performed through at least one multiport air release tee(750) that gets the ballast air(510) from some ballast air release valve(760) placed at the end of the same ballast air ducts(770) that delivers and extracts the ballast air(510) to and from the connected ballast chambers(490) each of the ballast air ducts(770) being connected to one of the compressed ballast air valves (740) and also to one of the ballast air release valve(750), the ballast air(510) being returned to the entry of the ballast air accumulator(710) and recirculated, or wherefrom the surplus ballast air(510) is vented to the atmosphere through at least one controlled atmospheric venting check valve(700).

The hull ballast water(500) is externally supplied to or evacuated from the ultra-large marine submersible transport boat's(100) hull ballast water storage bag(610) through the hull ballast water access point(640) and its inline ballast water access valve(650), the hull ballast water(500) being stored permanently onboard.

The impervious collapsible hull ballast water storage bags(610) are sized to contain and permanently be able to keep on board all hull ballast water(500) required for the operation of the ultra-large marine submersible transport boat(100) and are positioned inside the upper part of the submersible hull(150) for ease of access and maintenance.

The hull ballast water(500) is initially supplied for ballasting through the hull ballast water access point(640) as filtered fresh water treated with dissolved substances at a low concentration that inhibits any biological growth and that inhibit any chemical attack against concrete or its armature and against the hardware belonging to the hydro-pneumatic ballasting system(530) with which the hull ballast water(500) is in contact. For the transportation of fresh water, the required quantity of hull ballast water(500) represents about 3% of the transport capacity of the ultra-large marine submersible transport boat(100), meaning that the amount of hull ballast water(500) for the operation of one ultra-large marine submersible transport boat(100) is in the range of tens of thousands to millions of tons (or cubic meters).

When the submersible hull(150), configured for transporting fresh water as bulk liquid(110), is full of seawater(160), this being the usual state when it returns without bulk liquids(110) from a delivery station(130), the hull ballast water(500) is mainly stored in the hull ballast water storage bags(610) and the ballast chambers(490) are substantially empty of hull ballast water(500) and full of ballast air(510) so that the submersible hull(150) presents neutral buoyancy.

When the submersible hull(150) is full of fresh water transported as bulk liquid(110), the hull ballast water storage bags(610) are substantially empty and collapsed, most of the hull ballast water(500) being transferred for ballasting into the ballast chambers(490), so that, for neutral buoyancy, the ballasted submersible hull(150) balances the flotation of the contained fresh water. Thus, the hull ballast water(500) does not significantly reduce the ultra-large marine submersible transport boat(100) fresh water capacity.

However, the transportation capacity of the ultra-large marine submersible transport boat(100) for bulk liquids (110) denser than the seawater(160) is slightly reduced because, while transporting the denser bulk liquids(110) some of the hull ballast water(500) needs to be transferred away from the ballast chambers(490) to the hull ballast water storage bag(610) for neutral buoyancy.

Keeping the hull ballast water(500) on-board in a closed circuit of the ultra-large marine submersible transport boat (100) for very long operational terms, avoids the discharge of hull ballast water(500) into the environment and, by including corrosion inhibitors and disinfectants in the hull ballast water(500), it offers protection for the inside of the ballast chambers(490) and the whole hydro-pneumatic ballasting system(530).

The hull ballast water(500) from the hull ballast water storage bag(610) is controllably de-aerated through at least one ballast water bag deaerator(780) and one ballast water bag de-aeration check valve (790) that insulates the deaerator when the de-aeration does not take place.

The ballast water compartment from the ballast water accumulator(710) is controllably de-aerated by the state of the art means.

Also, the submersible hull(150) interior is provided with state of the art de-aeration means.

Any trapped air can diminish or hamper the ballasting and the depth maneuvering or angular stability of the ultra-large marine submersible transport boat(100).

Through the storage bidirectional pump(620) and the storage bidirectional valve(630), the hull ballast water storage bag(610) exchanges the hull ballast water(500) with the connected equipment that comprises the ballast water accumulator(710), the ballast water admission pump(590), and the ballast water evacuation distributor(580).

The ballast water pressure inside the ballast water accumulator(600) is kept between some engineering specified pressure limits sensed by some ballast water accumulator pressure sensors(795) and when the ballast water pressure gets outside of the specified limits the pressure is corrected by the ballasting command and control center (535) by commanding the exchange of some of the hull ballast water(500) between the ballast water accumulator(600) and the connected hull ballast water storage bag(610) by actuating the storage bidirectional pump(620) and by opening the controllable storage bidirectional valve(630).

For ballasting, the hull ballast water(500) is supplied by the ballast water admission pump(590) that has its inlet connected to the ballast water accumulators(600), to the ballast water admission distributor(570), and then to at least one of the connected admission check valve (550) that when commanded to open delivers the hull ballast water(500) through the connected ballast water pipe(540) to the connected ballast chamber(490).

For de-ballasting, the hull ballast water(500) is pneumatically evacuated from the ballast chambers(490) by injection of ballast air(510) as shown hereafter.

The ballast air(510) is drawn from the atmosphere through the atmospheric air connection(660) connected to the controllable atmospheric air entry check valve(670), and then through the atmospheric air compressor(680) followed by the atmospheric air entry check valve(670), to the entry of ballast air accumulator(710) and the entry of the ballast air compressor(720).

The ballast air(510) inside of the ballast air accumulator (710) is held at designated pressures between some engineering specified pressure limits sensed by some ballast air accumulator pressure sensors(797) and when the ballast air pressure gets outside of the specified limits, then either new air is furnished by the atmospheric air compressor(680) or some of the contained ballast air is vented to the atmosphere through the atmospheric venting check valve(700).

The ballast air compressor(720) delivers the ballast air (510) through the multiport air admission tee(730) to at least one of the compressed ballast air valves(740) that, when commanded to open, will allow compressed ballast air(510) to the connected ballast chamber(490), through its connected ballast air duct(770).

The de-ballasting is performed by commanding the ballast air compressor(720) to develop a high enough ballast air pressure in the ballast chambers(490) that are to be de-ballasted and by commanding the opening of the connected ballast water evacuation check valve(560), subsequently, the hull ballast water(500) from the ballast chamber(490) being pneumatically evacuated through the ballast water pipe (540), the ballast water evacuation check valve(560), the connected ballast water evacuation distributor(580), and back to the entry of the ballast water accumulator(600). Thus, the hull ballast water(500) is recirculated and made available for new ballasting.

The ballast air pressure in each ballast chamber(490) is measured and made available by a ballast air pressure sensor(810) fitted onto the ballast air duct(770) immediately after its compressed ballast air valve(740).

The difference between the ballast air pressure at the top of each ballast chamber(490) and its bottom ballast water pressure is measured with a ballast chamber differential pressure gauge(820) differentially connected, first onto the ballast air duct(770) immediately after its compressed ballast air valve(740), and second onto the upper end of a bottom pressure tube(830) that receives ballast air(510) from a small air compressor(840) with its air inlet from the ballast air accumulator(710) the small air compressor(840) delivering ballast air(510) to the bottom of the ballast chamber (490) displacing the hull ballast water(500) in the bottom pressure tube(830). The measurement of the pressure difference takes place when the bottom pressure tube(830) is filled with air to its bottom end from the ballast chamber (490) and the through-the-tube airflow is minimal, and when there is also minimal airflow through the ballast air duct (770), the connected compressed ballast air valve(740) being closed. The pressure difference measurement delivered by the ballast chamber differential pressure gauge(820) remotely indicates the level of the hull ballast water(500), and subsequently its quantity, in each of the ballast chambers (490), when the attitude of the ultra-large marine submersible transport boat(100) and the location and geometry of the ballast chamber(490) are taken into account.

The sensed pressures values from the ballast air pressure sensor(810) and ballast chamber differential pressure gauge (820) are fed to the ballasting command and control center (535) that establishes ballast air pressure limits and ballasting and de-ballasting requirements and commands for the hardware in connection with each ballast chamber(490).

The ballast air(510) is released back from each ballast chamber(490) through the same connected ballast air ducts (770) to the appropriate multiport ballast air release tee(750) through their connected ballast air release valve(760), the released ballast air(510) being returned to the entry of the ballast air accumulator(710) and the inlet of one of ballast air compressors(720).

The atmospheric air connections(660) are built so that the drawn ballast air is separated and water-free supplied by an air admission separator; when the atmospheric air cannot be separated from water or is not accessible, then the atmospheric air entry check valves(670) are commanded to close temporarily.

The atmospheric air connections(660) are positioned at the upper end of a snorkel tower(800) that is assembled upon the ultra-large marine submersible transport boat(100) and that has a height that allows the ultra-large marine submersible transport boat(100) to navigate at an engineering specified depth in complete submersion while having access to the atmospheric air, the snorkel tower(800) being a rigid and hydrodynamic structure.

Multiple hydro-pneumatic ballasting system(530) can be provided and connected to different groups of ballast chambers(490) situated in different positions on the submersible hull(150), through their multiport air admission tee(730), compressed ballast air valves(740), and ballast air ducts (770), the groups being formed for ballast chambers(490) that are at approximately the same depth during operation.

The multiple hydro-pneumatic ballasting systems(530) can also be interconnected by controlled bidirectional valves, at the connection points of their ballast water accumulators(600) respectively their ballast air accumulators (710).

In the present configuration of the invention, for de-ballasting, the ballast air(510) delivered by ballast air compressors(720) should bring the ballast air pressure in each ballast chamber(490) to de-ballasted, at a value superior to the pressure exercised by a column of seawater with the height from the surface of the ballast water in the ballast chamber(490) to the level of the ballast water accumulator (600) plus the pressure at the connection point of the ballast water accumulator(600).

Because the ballast water level in the ballast chambers (490) is established by gravitation, at least some of the ballast chambers(490) that will have their lowest point varying for positive respectively negative pitch angles will be provided with at least two ballast water pipes(540) each of the ballast water pipes(540) being connected to different ballast water evacuation check valves(580), and also being connected to the bottom front respectively to the bottom rear of the ballast chamber(490) the front and rear being established in connection with the ultra-large marine submersible transport boat(100).

Each ballast water admission distributor(570) and each ballast water evacuation distributor(580) is connected to multiple ballast chambers(490) in configurations similar to the one shown for only one ballast chamber(490) in the figures.

The ultra-large marine submersible transport boat(100) is provided with at least one depth sensor(850), at least one seawater three-axis speed sensor(860), at least one vertical attitude indicator(870) that indicates the vertical related to the uppermost line(210) and at least some locating means (880) like Global Positioning System (GPS) receivers aided by some inertial systems that cover the temporary lack of the GPS signal or any other positioning capabilities.

The ultra-large marine submersible transport boat(100) is provided with at least one seawater temperature sensor(890) and, for each of its collapsible bladders(140), is provided with at least one bulk liquid temperature sensor(900), at least one bulk liquid pressure sensor(910), and at least one bulk liquids flow sensor(915).

The ultra-large marine submersible transport boat(100) is also provided with a general command and control center (920) that receives the information from all the available sensors, receives data and remote commands by wireless and satellite communication means, and direct human commands from authorized personnel, and commands and controls the ballasting command and control center (535), the hydroplanes(250), the propulsion mechanisms(260), the power generation groups(270) and the other onboard equipment for all phases of operation of the ultra-large marine submersible transport boat(100).

The ultra-large marine submersible transport boat(100) is also provided on its upper part with at least one accessible dry deck cabin(930) that, when sealed, keeps its inside dry and at normal atmospheric pressure, and that hosts the command and control center (920) all active equipment of the hydro-pneumatic ballasting systems(530) that does not need to be placed at other locations, at least one auxiliary power unit, back-up batteries, and inverters.

Methods for Loading, Transporting, and Delivering of Large Quantities of Aqueous Bulk Liquids Using the Ultra-large Marine Submersible Transport Boats The methods for loading, transporting, and delivery of large quantities of aqueous bulk liquids(110) using the ultra-large marine submersible transport boats(100) comprise the provision of at least one ultra-large marine submersible transport boat(100), at least one supply station (120), and at least one delivery station(130) and also comprises the following operational phases controlled through the general command and control center (920) with some of the phases under human observation and control, that are implemented taking into account the weather and the swell, and that can also be implemented in part, or in a different order, that can be merged as a whole or in part into other methods for loading, transporting, and delivering large quantities of bulk liquid(110), or that can be repeated.

The ultra-large marine submersible transport boat(100) approaches the supply station(120) for being filled with bulk liquids(110) and is tugged into position adjacent to the supply station(120).

The ultra-large marine submersible transport boat(100) is moored adjacent to the supply station(120) and, by appropriate ballasting, is kept with its uppermost line(210) in the uppermost position, horizontal and substantially at the level of the seawater surface at the location.

The supply pipeline(380) is brought into position upon the ultra-large marine submersible transport boat(100) and the bulk liquids supply connector(400) is mated to the bulk liquids transfer connector(340) that has been uncapped.

The ultra-large marine submersible transport boat(100) is filled with bulk liquids(110) by the following operational sub-phases initiated by the human operator, that take place under the command and control of the general command and control center (920) and the ballasting command and control center (535):

(i) the transfer valves(330) are opened;

(ii) the supply valve(390) is opened;

(iii) the bulk liquid(110) is transferred from the bulk liquid source(360) by the delivery pump(420) or by gravity through the supply pipeline(380) into the collapsible bladders(140), simultaneously filling the collapsible bladders (140) while keeping the pressures in the upper part of the collapsible bladders(140) substantially equal to each other by commanding the opening and closing of the transfer valves(330); the collapsible bladders(140) are considered filled with the bulk liquid(110), when the pressure in the collapsible bladders'(140) upper part reaches a design specified value; for fresh water loaded as bulk liquid(110) in the cylindrical middle section(170), the design specified value is substantially close to 2.8% of pressure generated by an equivalent column of water with a height equal to the inside diameter of the submersible hull(150); for the collapsible bladders(140) that are not situated in the cylindrical middle section(170) of the ultra-large marine submersible transport boat(100) the appropriate pressure corrections are done;

(iv) during the filling of the collapsible bladders(140) the submersible hull(150) is proportionally ballasted, or deballasted as required, being kept at seawater level and in a horizontal and uppermost position by controllably introducing and removing hull ballast water(500) into, respectively from, some of the ballast chambers(490).

The bulk liquids supply connectors (400) are unmated from the bulk liquids transfer connector(340) that then is capped.

The supply pipeline(380), together with the supply valve (390) and supply connector(400), is moved away from the ultra-large marine submersible transport boat(100).

The ultra-large marine submersible transport boat(100) is un-moored and tugged away from the supply station(120)

The ultra-large marine submersible transport boat(100) then cruises toward an assigned delivery station(130) on a determined optimal route, speed, and depth schedule established following the swell and weather predictions, while the ultra-large marine submersible transport boat(100) is kept in an uppermost and horizontal position by active ballasting. The cruise is performed at snorkel depth for minimal drag, at times under severe swell conditions the ultra-large marine submersible transport boat being sunk deeper so that the structure is not affected.

When the swell and cruise depth requires that the atmospheric air connections(660) be cut off, the propulsion mechanisms(260) and the power generation groups(270) are stopped, and the general command and control center (920) and ballasting command and control center (535) and also all critical equipment, are kept functional using energy from the electrical batteries(1025) and the auxiliary power unit (1030) that is started when necessary and that can be fed with non-critically required ballast air(510) under supervision of the command and control centers(920), and (535).

The minimum quantity of ballast air(510) required to safely get the ultra-large marine submersible transport boat (100) in flotation to the sea surface is considered the critically required ballast air(510).

The ultra-large marine submersible transport boat(100) approaches the assigned delivery station(130) for delivering its bulk liquids(110) and is tugged into position adjacent to the delivery station(130).

The ultra-large marine submersible transport boat(100) is moored adjacent to the delivery station(130) and, by appropriate ballasting, is kept with the uppermost line(210) in the uppermost position, horizontal and substantially at the level of the seawater surface at the location.

The delivery pipeline(450) is brought into position upon the ultra-large marine submersible transport boat(100) together with the delivery pump(420) and the bulk liquids delivery connector (440) is mated to the bulk liquids transfer connector(340) that has been uncapped.

The ultra-large marine submersible transport boat(100) delivers its contained bulk liquids(110) by the following operational sub-phases that take place in time proximity:

(i) the transfer valves(330) are opened;

(ii) the delivery valve(430) is opened;

(iii) the bulk liquid(110) is transferred from the collapsible bladders(140) to the bulk liquids user(410) by simultaneously emptying the collapsible bladders(140) with the delivery pump(420) through the delivery pipeline(450) while keeping the pressures in the upper part of the collapsible bladders(140) substantially equal to each other by commanding the opening and closing of the transfer valves (330); the collapsible bladders(140) situated in the cylindrical middle section(170) of the ultra-large marine submersible transport boat(100) are considered empty when the pressure in their upper part reaches a value close to the atmospheric pressure; for the collapsible bladders(140) that are not situated in the cylindrical middle section(170) of the ultra-large marine submersible transport boat(100) the appropriate pressure corrections are done.

(iv) during the emptying of the collapsible bladders(140) the submersible hull(150) is proportionally de-ballasted or ballasted as required, being kept at seawater surface level and in a horizontal and uppermost position by the hydro-pneumatic ballasting system(530) that controllably removes and introduces hull ballast water(500) from, respectively into, some of the ballast chambers(490).

The bulk liquids delivery connector(440) is unmated from the bulk liquids transfer connector(340) that then is capped.

The delivery pipeline(450) together with the delivery pump(420), the delivery valve(430), and the delivery connector(440) are moved away from the ultra-large marine submersible transport boat(100).

The ultra-large marine submersible transport boat(100) is un-moored and tugged away from the delivery station(130).

The ultra-large marine submersible transport boat(100) navigates toward an assigned supply station(120) on a determined optimal route and depth schedule established following the swell and weather predictions, while the ultra-large marine submersible transport boat(100) is kept in an uppermost and horizontal position by active ballasting.

Then the above operational cycle of loading the bulk liquids at the supply station, carrying it to the delivery station, unloading it at the delivery station, and returning empty to the supply station repeats.

For work with bulk liquids of densities larger than the seawater density the loading and unloading procedures can be slightly different, as well as the configuration of the ultra-large marine submersible transport boat(100) and the delivery station(130).

Maintenance

The submersible hull(150) surfaces that come in contact with the seawater are cleaned with some underwater cleaning robots that move on the outside surface and the inside surface of the submersible hull(150) and clean the surfaces with water jets or brushes, eventually absorbing and filtering the hull fouling they detach.

The access inside the submersible hull(150) is done through one of the hull openings(320). The access is required for repairs and replacement of items like collapsible bladders(140), reinforcing elements(200), hull ballast water storage bags(610) as well as the bulk liquids transfer valves (330).

The cleaning of the outside surface of the submersible hull(150) is performed anytime, but it is preferred to take place while the ultra-large marine submersible transport boat(100) to be cleaned is stationary. The cleaning of the outside surfaces is performed for keeping it smooth and obtaining low hydrodynamic skin friction.

The inside cleaning of the submersible hull(150) is performed when the collapsible bladders(140) are collapsed and the underwater cleaning robots have access to the inside surface of the submersible hull(150); the inside surfaces on the lower part of the submersible hull(150) have priority because the solid materials can deposit there. The inside cleaning is also performed for avoiding long-range organism transfer.

Similar underwater cleaning robots can be provided for cleaning the outside and inside of the collapsible bladders (140) and the reinforcing elements(200).

The cleaning robots operate as Remote Operating Vehicles (ROV's); in case that their connection cables are cut-off the cleaning robots become Autonomous Underwater Vehicles that can be recuperated and the severed cables are recuperated too.

The hull ballast water(500) is reused for multiple operational cycles, being kept on board in a closed circuit and no deposits and no organism growth should appear in the hull ballast water(500) itself or on the ballast chamber walls or in the hydro-pneumatic ballasting system(530), so the maintenance related to ballasting is minimal beyond regular testing and completing the quantity of the hull ballast water(500).

Access to the ballast chambers(490) can be done with slim robots through the ballast water pipe(540) and ballast air ducts(770). If required, in extreme cases, cuts for access can be applied through the inner shell(470) or outer shell (460) and then repaired. Sealed visitation hatches can also be provided for the ballast chambers(490)

When necessary the hull ballast water(500) is regenerated for reuse by filtering and adding inhibiting additives. Finally, at the end of life of the ultra-large marine submersible transport boats(100), the hull ballast water(500) is neutralized and processed accordingly.

Visual inspection of the whole the submersible hull(150), as well as the collapsible bladders(140) and the hull ballast water storage bags(610), is performed with ROV's as required.

All equipment is positioned on the upper part of the ultra-large marine submersible transport boat(100) and is easily accessible and serviceable when the ultra-large marine submersible transport boat(100) floats at the sea surface. The only exception might be the hatches and actuators for closing the large hull openings(320) used for the continuous flow of seawater(160) that however, are positioned at reasonable depth for access.

Underwater human or ROV operations might be required during maintenance.

Manufacturing of the Ultra-large Marine Submersible Transport Boats

The submersible hull(150) of the ultra-large marine submersible transport boat(100) is manufactured from some large dimension precast panels(940) that contain at least one ballast chamber(490) and are also pre-fitted with the attachment fixture for the reinforcing elements(200) mounting onto the submersible hull(150).

The precast panels(940) are manufactured separately of each other, onshore, in a dry dock, and left to cure.

Then the orifices where the hull ballast water(500) and the ballast air(510) are to be introduced into ballast chambers (490), as well as any other orifices of the ballast chambers (490) of the precast panels(940), are plugged with air trapped inside the ballast chambers(490) of the precast panel.

The precast panels(940) are moved one after another for assembly to form the submersible hull(150), first into the shallow sea, and then, while floating, they are tugged toward a marine assembling yard with sheltered water at least as deep as the maximum transversal diameter of the future ultra-large marine submersible transport boat(100).

The assembling of the submersible hull(150) takes place inside the marine assembly yard, on at least one assembling floating platform(950) that is provided with support rollers (953) that can be substantially aligned to the curved surface of the inner shell(470), on the rollers the unassembled, panels as well as the assembled multi-panel sections having 6 degrees of freedom for positioning adjustments during assembling.

The assembling is initiated with assembling the precast panels(940) to form transversal annular multi-panel sections of the submersible hull(150) starting with the lowest precast panels(940) that will compose the submersible hull(150), although in alternate assembly procedures other shapes of multi-panel sections of the submersible hull(150) can be implemented.

For assembling, each still unassembled precast panel(940) that can weigh a few thousand tons, is pulled above the seawater(160) onto the assembling floating platform(950).

On the assembling floating platform(950), the ballast water pipes(540), ballast air duct(770), and bottom pressure tubes(830) are fixed and sealed to each of the ballast chambers(490) of the precast panel(940) and the laterals of the precast panels(940) are washed off for being prepared for assembling.

The precast panels(940) pulled on the assembling floating platform(950) are positioned so that after assembling they will form transversal multi-panel sections of the submersible hull(150), and, after appropriate positioning, the precast panels(940) are mutually assembled.

Their assembling implies the joining together by welding or other means like crimping, gluing, or wire wrapping of the existing structural armatures of the adjacent precast panels(940) and also implies the filling of the inter-panel gap with an assembly seam(955) that is poured between the adjacent precast panel(940) and that can be formed of concrete, ferro-cement, plastics, or any other state of the art material that has the strength, adhesion, and chemical stability to permanently join the precast panels(940) for the building of the submersible hull(150).

After being assembled, the precast panels(940) slide on the assembling floating platform(950) into the seawater, the assembled panels being partially filled with air and some hull ballast water(500) so that they have neutral buoyancy.

All ballast water pipe(540), ballast air ducts(770), and bottom pressure tubes(830) that have been fixed are routed adjacent to the already assembled precast panels(940) in the direction of the uppermost line(210) and are plugged so that no water is introduced to or lost from their ballast chambers (490).

After one half of an annular multi-panel section of the submersible hull(150) is assembled, the half of the annular multi-panel section is rotated back on the assembling floating platform(950), and the remaining precast panels(940) for the second half of the annular multi-panel section are assembled starting from the future bottom of the submersible hull(150) to its future uppermost line(210) to complete the annular section.

For assembling of the last precast panels(940) in a transversal multi-panel annular section of the submersible hull (150) the panels are introduced axially into their position and the annular multi-panel section is finally closed.

Each finalized transversal annular multi-panel section of the submersible hull(150) is unloaded from the assembling floating platform(950) and is parked in neutral flotation in proximity, with its axis in a horizontal position.

Each finalized transversal annular multi-panel section of the submersible hull(150) is then positioned on the assembling floating platform(950), adjacent to another appropriate neighboring transversal annular multi-panel section of the submersible hull(150) and they are mutually assembled with the same assembly seam(955) after the armatures of the precast panels(940) from the adjacent finalized annular multi-panel sections are joined.

For assembling the annular multi-panel sections it is necessary that these are in flotation above the seawater and that they are rotated over the assembling floating platform (950) so that the zone where the assembling operations take place is above the water. For the flotation and the rotation of the annular multi-panel sections, the ballasting and deballasting of the ballast chambers(490) through the ballast air ducts(770) and ballast water pipes(540) are required.

The configuration of the assembling floating platform (950) for the rounded bow(180) and tapered stern (190) is slightly different being non-cylindrical shapes, and it is preferable to start the assembly of the submersible hull(150) from these two zones and to attach the resulting halves of ultra-large marine submersible transport boat(100) closer to the middle of the submersible hull(150).

Taking care that the assembling floating platform(950) do not interfere, the assembly of the reinforcing elements(200) and the collapsible bladders(140) can be done simultaneously with the assembly of each transversal multi-panel section of the submersible hull(150), and the assembled collapsible bladders(140), partially filled with air, can be used for the required flotation of the assembled part of the submersible hull(150) during manufacturing.

However, the items of the ultra-large marine submersible transport boat100) that are not positioned inside the submersible hull(150) before its final closure, can be introduced inside the submersible hull(150) through its hull openings (320).

After the closing of the submersible hull(150) the assembling floating platforms(950) caught inside are disassembled into smaller pieces and extracted from the submersible hull(150) through its hull openings(320).

It is possible to provide specific hull openings(320) just for manufacturing access and to close these hull openings (320) at manufacturing completion.

The final assembly of the equipment for the ultra-large marine submersible transport boat(100) is performed with the uppermost line(210) in the uppermost position, the equipment being in its majority located on the upper part of the ultra-large marine submersible transport boat(100).

Underwater human or ROV operations are required during manufacturing.

End of Life Disposal

At their end of life, the ultra-large marine submersible transport boats(100) are prepared for disposal by dismantling and removing all the on-board equipment.

The hull ballast water(500) is neutralized, and processed accordingly for disposal or reused.

The concrete ultra-large marine submersible transport boats(100) are then disposed of by crushing and reusing the concrete and the armature or by low charge demolition and wrecking to create marine habitats.

Basic and Alternative Configurations of the Invention

The ultra-large marine submersible transportation boat (100) in the basic configuration claimed by the invention is used for the transportation of fresh water designated as bulk liquid(110), and the collapsible bulk liquids bladders(140), the bulk liquids transfer valves(330), and the bulk liquids transfer connectors(340) are compatible with fresh water as bulk liquid and they together with any other parts in contact do not contaminate or degrade the quality of the transported fresh water.

In another configuration, the ultra-large marine submersible transportation boat(100) claimed by the invention is used for the transportation of irrigation drainage water designated as bulk liquid(110).

In another configuration, the ultra-large marine submersible transportation boat(100) claimed by the invention is used for the transportation of diverse aqueous bulk liquids (110) with densities close to that of the seawater(160).

In the basic configuration, the ultra-large marine submersible transport boat(100) is built with its power generation groups(270) onboard, inside one of its accessible dry deck cabins(930), and has its propulsion mechanism(260) also fitted onboard.

In another configuration, the ultra-large marine submersible transport boat(100) is built with its power generation groups(270) and its propulsion mechanisms(260) placed on some tugboats(960) that pull the ultra-large marine submersible transport boat(100) with tug lines(310), and deliver electrical power for the onboard equipment through interconnection electrical power cables(965) attached adjacent to the tug lines(310) and has some permanent and direct human command and supervision present on the tugboat.

In the basic configuration, the ultra-large marine submersible transport boat(100) has the on-board power generation groups(270) built as internal combustion engines, like diesel motors that drive electric generators that at their turn drive the propulsion mechanisms(260), the engine air inlet and exhaust being placed on the snorkel tower(800).

In another configuration, the ultra-large marine submersible transport boat(100) has the on-board power generation groups(270) built with at least one nuclear reactor connected to turbines driving electric generators that at their turn drive the propulsion mechanisms(260).

In another configuration built for shorter haul operations, the ultra-large marine submersible transport boat(100) has the on-board power generation groups(270) replaced by an onboard group of batteries that are charged from shore while the ultra-large marine submersible transport boat(100) is moored for loading and unloading the bulk liquids(110), the onboard group of batteries driving the propulsion mechanisms(260) while cruising.

In another configuration, the ultra-large marine submersible transport boat(100) has its submersible hull(150) with its cylindrical middle section(170) built as a multiple-sided polygonal cylinder(970) instead of being built as a circular cylinder, the polygonal cylindrical middle section(170) being designed to smoothly join the rounded bow(180) respectively the tapered stern(190) that at their turn can present transversal sections built as multiple-sided substantially regular polygons.

The ultra-large marine submersible transport boat(100) claimed by the invention has its reinforcing elements(200) built as spokes under tension.

The ultra-large marine submersible transport boat(100) claimed by the invention has its reinforcing elements(200) positioned radially outside the collapsible bladders(140).

The ultra-large marine submersible transport boat(100) claimed by the invention is built with some of its collapsible bladders(140) that, when filled with bulk liquids(110), are substantially shaped as right-angle cylinders with their axes parallel to the longitudinal axis of the ultra-large marine submersible transport boat(100) filling the inner shell(470) almost completely and having the outside of at least one of their flat faces touching some of the reinforcing elements (200) and the vertical flat face of the neighboring collapsible bladder(140), the filled collapsible bladders leaving a minute longitudinal gap between their walls and part of the inside wall of the inner shell(470) for continuous flow of the seawater(160) and also for variations in the volume of the hull ballast water storage bag(610) when the ballasting is adjusted for depth and any thermal expansion.

In another configuration, ultra-large marine submersible transport boat(100) claimed by the invention is built with some of its collapsible bladders(140) that have at least part of their walls formed by an inner shell impervious part(980) and have at least another part of their walls formed by a flexible and mobile impervious membrane(990) that is imperviously edge-fixed to the inner shell impervious part (980) on its membrane edge(1000).

In another configuration, the ultra-large marine submersible transport boat(100) claimed by the invention is built with at least one of its collapsible bladders(140), when filled, with bulk liquids(110) built as substantially shaped as right-angle cylinders with their axes aligned with the longitudinal axis of the ultra-large marine submersible transport boat (100) and with one of its flat bladder wall(1010) used as a radial reinforcing element(200), that is radially fixed onto the perimeter of inner shell(470) with some reinforcement attachments(1020) the continuous longitudinal seawater circulation being ensured in any filling state of the collapsible bladders(140).

In another configuration, the ultra-large marine submersible transport boat(100) claimed by the invention is built with at least one collapsible bladder(140) whose transfer valve(330) is directly connected to the external onboard bulk liquids transfer connector(340).

In another configuration, the ultra-large marine submersible transport boat(100) claimed by the invention is used for the transportation of fresh water designated as bulk liquid (110) and is built with at least one of its collapsible bladders (140) that, when filled with fresh water, is shaped like a cylinder and has some of its reinforcing elements(200) positioned and contained inside one of the collapsible bladders(140), thus, the reinforcing elements(200) being kept in the lower corrosion environment offered by the fresh water.

In another configuration, the ultra-large marine submersible transport boat(100) claimed by the invention is provided with no hydroplanes(250).

The ultra-large marine submersible transport boat(100) claimed by the invention has none of its hull openings(320) provided with at least one electrically driven seawater circulation propeller(328) that increases the seawater(160) continuous change inside the submersible hull(150).

The ultra-large marine submersible transport boat(100) claimed by the invention has its circular cylindrical middle section(170) provided with its concrete outer shell(460) and concrete inner shell(470) built at a substantially constant thickness and distance from each other with the ballast chambers(490) substantially uniformly shaped and distributed on the surface of the cylindrical middle section(170) and provided with a regular pattern of chamber reinforcements(520).

In another configuration, the ultra-large marine submersible transport boat(100) claimed by the invention has the upper part of its submersible hull(150) provided with the outer shell(460) and the inner shell(470) built thicker and with larger distances between the outer shell(460) and inner shell(470) so that the upper part of the ultra-large marine submersible transport boat(100) resists better to wave-induced pressures and to collisions with floating stray objects.

The ultra-large marine submersible transport boat(100) claimed by the invention can be isolated from the atmosphere and put in complete immersion with atmospheric air connection(660) under the seawater(160) and with all valves connected to atmospheric air connection(660) closed, the hydro-pneumatic ballasting system(530) being kept functional in complete immersion for ballasting and subsequent reemerging of the ultra-large marine submersible transport boat(100).

The ultra-large submersible transport boat(100) claimed by the invention is fitted with some large electrical batteries (1025) to provide emergency electrical power when no other power source is available. The large electrical batteries (1025) are charged by the onboard or external available power supplies, and their status and usage are controlled by the general command and control center (920).

The ultra-large submersible transport boat(100) claimed by the invention is provided with at least one auxiliary power unit(1030) (APU) that contains a combustion engine that, when the ultra-large marine submersible transport boat(100) is in complete submersion has its atmospheric air connection(660) cut off by an APU air inlet cut-off valve (1040), and is fed with ballast air(510) through an APU ballast air access valve(1050) the auxiliary power unit (1030), APU air inlet cut-off valve(1040), and APU ballast air access valve(1050) being controlled by the general command and control center (920).

The ultra-large submersible transport boat(100) claimed by the invention is built with its general command and control center (920) configured so that the ultra-large marine submersible transport boat(100), while navigating, functions as an Automatic Underwater Vehicles (AUV) with remote human commands and supervision, and when close to the supply stations(120) and delivery station(130), the ultra-large marine submersible transport boat(100) functions at the surface of the sea under direct human commands and supervision.

In another configuration, the ultra-large submersible transport boat(100) claimed by the invention is provided with an impervious command nacelle(1060) that has a personnel accessible cabin, mounted close to the upper side of the snorkel tower(800) that is usually kept above the seawater(160) during cruising and that hosts some of the electronics and the human interface of the ultra-large marine submersible transport boat(100) the command nacelle(1060) being built with a detachable pod(1070) that can be detached in cases of deep submersion while the personnel is hosted in the command nacelle(1060).

The command nacelle(1060) is accessed from the deck walkway(220) through a ladder that is positioned inside the snorkel tower(800) in one of its locked and impervious zones.

The advantage of the command nacelle provision is that the existing personnel can have a smooth cruise independent of waves and swell due to the large dimension, cruising depth, and inertia of the ultra-large marine submersible transport boat(100).

The following items not shown on figures are also provided to the ultra-large marine submersible transport boat (100) some of them required due to the maritime and other regulations and necessities: at least one anchor, navigation lights, communication gear, radar, and transponder (automatic identification system).

Description of a Constructive Example

For the purpose of exemplification of the invention, an ultra-large marine submersible transportation system transferring fresh water to Southern California from rivers in Alaska and other continental USA west coast location was considered.

Its ultra-large marine submersible transport boats(100) used for the transportation system were designed to be 90 meters in diameter and 700 meters in length. This ultra-large marine submersible transport boat(100) can economically transport about 4 million cubic meters (3300 acre-ft) of fresh water, a quantity about ten times larger than the largest ULCC tanker in service.

For these ultra-large marine submersible transport boats (100) of 4 million tons, some good locations for the supply stations(120) are the entrance to Sawmill Cove east of Sitka, Ak., USA, and the mouths of the rivers from some lakes on the Eastern Baranof Island, Ak., USA. Sitka and East Baranof Island locations have sea depths of over 90 meters (300 ft) very close to the shore so that the building of the supply stations(120) is relatively easy. Sitka location has a total delivery capacity of about 400 million cubic meters (320,000 acre-ft) of fresh water per year with some already built facilities like the artificial lake that can be used for supplying the fresh water, and also offer a year-round mild climate for its latitude.

Potential supply stations(120) with larger quantities of fresh water available are the mouths of Stikine and Copper rivers in Alaska, and closer to Southern California, the mouths of Klamath River (California) and Columbia River (Oregon).

A good location for a delivery station(130) is Monterey Bay, Calif., with remote delivery to San Luis Reservoir and Westland Water District that also has irrigation drainage water issues that can be solved by the present invention, and also with eventual delivery to San Francisco area. Some other good locations for delivery stations(130) in Southern California are Oxnard and Santa Monica Bay with delivery for the Los Angeles area, and north of Point La Jolla with delivery for San Diego/Tijuana area. All these locations have depths of over 90 meters (300 ft) close to the shore.

It is worth noting that the supply station(120) locations, as well as the delivery station(130) locations, can be changed in time, in accordance with the fresh water availability and demand.

A round trip for the ultra-large marine submersible transport boat(100) from the supply station(120) near Sitka, Ak., USA, to a delivery station(130) near Los Angeles, Calif., USA is about 6000 km (3700 miles) and it is expected, for the mature product phase, that the cost of transportation is about $0.15 per cubic meter ($190 per acre-foot). The supply from Sitka is of prime quality and also seasonal and complementary to California's fresh water availability, with summer and fall months supplying the largest amount of water.

For a shorter route from a supply station(120) on Klamath River mouth, California, USA, and a delivery station(130) near San Diego, Calif. USA, the cost of transportation is estimated at $0.06 per cubic meter ($74 per acre-foot). The Klamath River has a delivery capacity of over 3 million acre-feet per year without much environmental impact, but it is seasonal with high water availability during wintertime.

Other potential supply stations(120) are at the Eel River (California) mouth and Russian River (California) mouth, with fresh water availability also especially in the winter months and also Columbia river (at the border of Washington and Oregon states).

It should be remarked that supplies with a lot of sediments create an operational problem due to the formation of deposits in the collapsible bladders(140), that need to be cleaned.

The supply pipelines(380) and the delivery pipeline (450) should be of such diameters that the fresh water can be transferred at an optimal debit that does not keep the ultra-large marine submersible transport boat(100) stationary for too long and does not require an excessive pipeline pressure drop. Thus, for a Sitka, Ak., USA supply station, for a length the delivery pipeline of 5 km (3 miles) and 2 m (6.6 ft) diameter and for a debit of about 15 cubic meters/second (545 cubic ft/sec) that will impose a 3 day stationing for filling the 4 million cubic meters ultra-large marine submersible transport boat(100), the pipeline pressure drop would be about 5 bar (73 psi), this pressure being low enough so that the supplied fresh water can be gravity fed through the supply pipeline(380) after it passes through Silka's existing Blue Lake power station generators.

The axial size of the filled cylindrical collapsible bladders (140) can be from 50 to 150 meters, optimized for cost and engineering, with a diameter substantially equal to the inside of the reinforced concrete submersible hull(150). The collapsible bladders are built from state of the art synthetic materials that do not contaminate the transported water.

For the basic invention variant, the reinforcing elements (200) are built from synthetic material ropes or heavy-duty steel drill pipes, that are fixed to each other employing a central core piece.

The requirements for the structure ballasting and floating is met by a substantially uniform construction of the structure of the submersible hull(150) with the possible exception of the non-cylindrical bow and stern zones that will be ballasted and assigned buoyancy in accordance with the density of the liquid contained inside the contained submersible hull(150). However, the increase in submersible hull thickness in its upper part is implemented in alternate configurations.

In the present configuration, the required ballasting for a unit of hull area is dimensioned as equal to the buoyancy of a sea immersed content of fresh water corresponding to the area. That means 2.8% of the weight of fresh water(110) of 22 meters (72 ft) which is about half of the radius of submersible hull(150) cylinder, meaning an equivalent mass of ballasting of 614 kg per each square meter of the reinforced concrete submersible hull(150). The concrete ballasting equivalent in seawater(160) is 14000 N per cubic meter, meaning that the submersible hull(150) in its cylindrical middle section(170) should be built with an equivalent thickness of at least 0.44 meters. For the present constructive example, the outer shell(460) and the inner shell(470) are proposed to be 0.16 meter thick each, and the ballast chambers(490) separating partitions(480) and chamber reinforcements(520) will add a concrete volume equivalent to a thickness of 0.16 meters. The ballast chamber(490) will have a longitudinal dimension of about 50 meters and the dimension of about 20 meters on the circumference of the cylindrical middle section(170) of the submersible hull (150). The chamber reinforcements(520) will be optimized in accordance with the operational loads.

The distance between the outer shell(460) and inner shell(470) inside the ballast chambers(490) is chosen to be about one meter so that the buoyancy of de-ballasted ballast chambers(490) can lift the whole ultra-large marine submersible transport boat(100) filled with seawater(160).

It should be noted that the submersible hull(150) is an extremely strong and rigid structure that can successfully withstand the operational loads like the local bending due to the waves during navigation and due to collisions with stray objects. It also is a fault-tolerant construction due to the multitude of ballast chambers(490) and, by optimal design of the chamber reinforcements(520) the ballast chambers (490) can withstand very high differential pressures.

Other important parameters for the ultra-large marine submersible transportation system for bulk fresh water are the following:

the design cruise speed of the ultra-large marine submersible transport boat(100) is between 2 and 4 meters per second meaning a speed of 4 to 8 nautical knots; higher or lower designed cruise speeds are possible and the investment and operational costs need to be optimized.

the drag coefficient is about 0.08 with reference to the maximum transversal cross-section area of the submersible hull(150);

the installed power is about 20 Mw, but less power, depending on cruise speed, might be needed;

the cruise drag force is estimated at 3.2MN (320 tonne-force) at a speed of 3.5 m/s for the ultra-large marine submersible transport boat(100) with the above configuration.

The operational forces in the exemplified structure are acceptable; however, the final configuration has to be optimized and navigational restrictions might be placed due to high swell.

The required concrete volume for the building of the ultra-large marine submersible transport boat(100) for the exemplified configuration is estimated at 100 000 cubic meters and it is expected to represent over 90% of the solid mass of the ultra-large marine submersible transport boat (100). The cost of one ultra-large marine submersible transport boat(100) in the configuration is estimated at US$50 000 000 (all cost are in US$ of the year 2020). A fleet for transporting all available Sitka, Ak., USA Blue Lake water of 320 000 acre-feet per year to Southern California will need eight pieces of the ultra-large marine submersible transport boats(100) and at least one supply station(120) and one delivery station(130).

The expected cost for this ultra-large marine submersible transportation system is about US$500,000,000 and includes eight pieces of the ultra-large marine submersible transport boats(100), plus one supply station(120) and one delivery station(130). The amortization for transport calculations is considered for 30 years, and this length of time is taken into account for computing the cost of transportation. However, the economics for the actual systems can substantially vary due to the chosen system configuration, materials, manufacturing equipment, and labor cost.

The previous figures indicate an investment of about $1600 per acre-foot of fresh water of excellent quality, delivered each year, for 30 years.

The fresh water transportation system per present invention can be multiplied for increased water transportation capabilities.

REFERENCE NUMBER LIST ultra-large marine submersible transport boat 100
bulk liquids 110
supply station 120
delivery station 130
collapsible bladders 140
submersible hull 150
seawater 160
circular cylindrical middle section 170
rounded bow 180
tapered stern 190
reinforcing elements 200
uppermost line 210
deck walkway 220
country of registration flag 230
assigned name 240
hydroplanes 250
propulsion mechanisms 260
power generation groups 270
chocks 280
towing pads 290
mooring lines 300
tug lines 310
hull openings 320
hull openings cover 325
seawater circulation propeller 328
bulk liquids transfer valve 330
bulk liquids transfer connector 340
bulk liquids transfer canal 345
sea coasts 350
bulk liquids source 360
supply pumping station 370
supply pipeline 380
supply valve 390
bulk liquids supply connectors 400
bulk liquids user 410
off-shore delivery pump 420
off-shore delivery valve 430
bulk liquids delivery connectors 440
delivery pipeline 450
outer shell 460
inner shell 470
separating partitions 480
ballast chambers 490
hull ballast water 500
ballast air 510
chamber reinforcements 520
hydro-pneumatic ballasting system 530
ballasting command and control center 535
ballast water pipe 540
ballast water admission check valve 550
ballast water evacuation check valve 560
ballast water admission distributor 570
ballast water evacuation distributor 580
ballast water admission pump 590
ballast water accumulator 600
hull ballast water storage bag 610
ballast water storage bidirectional pump 620
storage bidirectional valve 630
hull ballast water access point 640
ballast water access valve 650
atmospheric air connection 660
atmospheric air entry check valve 670
atmospheric air compressor 680
atmospheric venting check valve 700
ballast air accumulator 710
ballast air compressor 720
multiport air admission tee 730
compressed ballast air valves 740
multiport air release tee 750
ballast air release valve 760
ballast air ducts 770
bag deaerator 780
bag de-aeration check valve 790
ballast water accumulator pressure sensors 795
ballast air accumulator pressure sensors 797
snorkel tower 800
ballast air absolute pressure sensor 810
ballast chamber differential pressure gauge 820
bottom pressure tube 830
small air compressor 840
depth sensor 850 2
three-axis speed sensor 860
vertical attitude indicator 870
GPS positional equipment 880
seawater temperature sensor 890
bulk liquids temperature sensor 900
bulk liquids pressure sensor 910
flow sensor 915
general command and control center 920
dry deck cabin 930
precast panels 940
assembling floating platform 950
support rollers 953
assembly seam 955
tugboats 960
electrical power cables 965
polygonal cylinder 970
inner shell impervious part 980
flexible and mobile membrane 990
membrane edge 1000
bladder wall 1010
reinforcement attachments 1020
large electrical batteries 1025
auxiliary power unit 1030
APU air inlet cut-off valve 1040
APU ballast air access valve 1050
command nacelle 1060
detachable pod 1070

What is claimed is:

1. An ultra-large marine submersible transport boat built to be loaded with aqueous bulk liquids, transport them and deliver the bulk liquids, the ultra-large marine submersible transport boat comprising an elongate hydrodynamic-shaped rigid and hollow submersible hull that is double-walled and controllable-ballasted, built from heavier-than-seawater materials and having its double-wall formed by an outer shell and a spaced-apart inner shell joined by separating partitions defining a plurality of separate impervious ballast chambers therebetween that are controllably ballasted independently of each other by partially and controllably filling them with hull ballast water and controllably de-ballasted by the elimination of at least some of the chamber-contained hull ballast water, the submersible hull enclosing a plurality of collapsible bulk liquid bladders shaped to substantially occupy almost the whole free hollow inside of the submersible hull when filled with bulk liquids to be transported, and collapsing when emptied, the collapsible bulk liquid bladders being filled, emptied, and isolated by at least one bulk liquids transfer valve that is assembled in line with a bulk liquids transfer connector that sequentially and temporarily connects the collapsible bladers for the bulk liquids supply and delivery, the submersible hull having enough heavier-than-seawater material and the ballast chambers' volumes large enough, so that the ultra-large marine submersible transport boat with all its contained fluids in any operational status, can, by ballasting, respectively deballasting, be controllably submerged and also from a submerged position can be brought to the seawater surface, and by differential ballasting of the ballast chambers, can have its pitch, and roll controlled, also, the submersible hull having a multitude of hull openings communicating from the outside through the submersible hull, the ultra-large marine submersible transport boat also comprising an onboard hydro-pneumatic ballasting system that contains a ballasting command and control center that commands and control the feeding and extraction of hull ballast water and ballast air, into and from the ballast chambers, the ballasting system being also provided with a predetermined quantity of hull ballast water and a plurality of collapsible hull ballast water storage bags located within the submersible hull's hollow interior cavity, that store in a closed circuit the ballast water when removed from the ballast chambers and any other parts of the hydro-pneumatic ballasting system, the hydro-pneumatic ballasting system being provided with information from a vertical attitude indicator that is fitted on the ultra-large marine submersible transport boat and that indicates the engineering designated vertical, the hydro-pneumatic ballasting system being used to exchange hull ballast water amongst the ballast chambers for the ultra-large marine submersible transport boat's pitch and roll control in relation with the engineering designated vertical, the hydro-pneumatic ballasting system being provided with depth information from some depth sensors that are fitted on the ultra-large marine submersible transport boat, the hydro-pneumatic ballasting system, for depth control, being used to exchange hull ballast water between the ballast chambers and the plurality of collapsible hull ballast water storage bags, the hull ballast water being continuously reused and kept in close circuits separated from the surrounding seawater, and the air for deballasting being provided from and respectively released to the atmospheric air through an atmospheric air connection, the ultra-large marine submersible transport boat also comprising a snorkel tower that is affixed to the upper part of the submersible hull and that has a height that allows the ultra-large marine submersible transport boat to navigate at a specified depth in submersion while providing the atmospheric air connection access to the atmospheric air, the snorkel tower being a rigid and hydrodynamic structure, for maneuvering and cruising the ultra-large marine submersible transport boat being also provided at least one power generation group driving at least one propulsion mechanism enabling the ultra-large marine submersible transport boat to be propelled.

2. The ultra-large marine submersible transport boat of claim 1, wherein its hydro-pneumatic ballasting system is provided with a plurality of ballast water controllable pumps, ballast water accumulators, ballast water controllable valves, and ballast water distributors that actively supply under hydraulic pressure, respectively passively allows to evacuate under pneumatic pressure, the hull ballast water through a multitude of ballast water pipes independently to, respectively from, each ballast chamber, and also being provided with a plurality of ballast air controllable compressors, controllable air valves, air accumulators, and air admission and air release tees connected through air ducts independently to each ballast chambers to controllably make the hull ballast water to be pneumatically evacuated and returned from the ballast chambers by injection of pressurized ballast air into the ballast chambers.

3. The ultra-large marine submersible transport boat of claim 1 further comprising a general command and control center that controls the hydro-pneumatic ballasting system the power generation group, and the propulsion mechanism, for the maneuvering and navigation of the ultra-large marine submersible transport boat.

4. The ultra-large marine submersible transport boat of claim 1 further comprising a plurality of chocks and towing pads mounted on the outside of the submersible hull, to which mooring and tug lines can be attached.

5. The ultra-large marine submersible transport boat of claim 1, wherein the at least one of the collapsible bulk liquids bladders, at least one bulk liquids transfer valves, and at least one of the bulk liquids transfer connectors that are in contact with the fresh water are compatible with fresh water as a transported bulk liquid and are built to keep its quality, the ultra-large marine submersible transport boat being used for the transportation of fresh water.

6. The ultra-large marine submersible transport boat of claim 1, wherein the submersible hull has an overall length of 400 to 2400 meters, a length to the maximum transverse dimensional ratio of 6 to 9, and the hollow interior cavity having a capacity of over 550,000 DWT.

7. The ultra-large marine submersible transport boat of claim 1, wherein the submersible hull has a rounded bow, a cylindrical middle section, and a tapered stern.

8. The ultra-large marine submersible transport boat of claim 1, wherein the submersible hull has a substantially circular transversal section.

9. The ultra-large marine submersible transport boat of claim 1, wherein the submersible hull built has a substantially elliptical transversal section.

10. The ultra-large marine submersible transport boat of claim 1, wherein the submersible hull is provided with a cylindrical middle section built as a multiple-sided polygonal section that smoothly joins to a rounded bow and a tapered stern.

11. The ultra-large marine submersible transport boat of claim 1, wherein the submersible hull has enough heavier-than-seawater material and the ballast chambers' volumes large enough, so that the controlled buoyancy of the ultra-large marine submersible transport boat with its submersible hull in a submerged position and with all its contained fluids in any operational status can, by ballasting, be controllably varied from an engineering specified negative value to an engineering specified positive value, and also so that engineering specified pitch and roll moments can be applied upon the ultra-large marine submersible transport boat in normal operational positions, by bow-to-stern and port-to-starboard differential ballasting, thus being possible to control the depth of the ultra-large marine submersible transport boat, and also its pitch, and the roll by controlled rotation around its transversal and longitudinal axes.

12. The ultra-large marine submersible transport boat of claim 1, wherein the submersible hull is provided with a multitude of hull openings through which the surrounding seawater circulates into and from the submersible hollow interior.

13. The ultra-large marine submersible transport boat of claim 12, wherein the submersible hull has at least some of its hull openings provided with some covers means that can be closed and also moved.

14. The ultra-large marine submersible transport boat of claim 12, wherein the submersible hull has at least some of its hull openings positioned at the bow and some other hull openings positioned at the stern, the openings being at least partially unobturated during cruising and through which a continuous flow of seawater inside the submersible hull is established when the ultra-large marine submersible transport boat moves so that there is no long-range transportation of seawater contained inside of the submersible hull, as bulk ballast.

15. The ultra-large marine submersible transport boat of claim 1, wherein the submersible hull's heavier-than seawater building material consists mainly of reinforced concrete.

16. The ultra-large marine submersible transport boat of claim 1, further comprising a plurality of chamber reinforcements built inside its ballast chambers, between the outer shell and the inner shell, to sustain the loads from the pressure difference between the inside and outside of the ballast chambers and the shear loads appearing between the outer shell and the inner shell.

17. The ultra-large marine submersible transport boat of claim 1, wherein the power generation groups and the propulsion mechanisms are on-board and permanently fitted to the submersible hull.

18. The ultra-large marine submersible transport boat of claim 17, wherein at least one of the power generation groups of the internal combustion type that has its air intake through a snorkel tower that is positioned upon the submersible hull and has a hydrodynamic shape and height that allows the ultra-large marine submersible transport boat to navigate at engineering specified depths in complete submersible hull submersion while the power generation group has access to the atmospheric air through the air inlet built onto the snorkel tower.

19. The ultra-large marine submersible transport boat of claim 17 having at least one of its power generation groups built as an onboard nuclear power reactor.

20. The ultra-large marine submersible transport boat of claim 1, wherein at least one of the power generation group and at least one of the propulsion mechanism are positioned on a separate tugboat that is attached to the submersible hull and pulls the ultra-large marine submersible transport boat with some tug lines.

21. The ultra-large marine submersible transport boat of claim 1, further comprising a plurality of hydroplanes steerably mounted to the submersible hull and acting as control surfaces.

22. The ultra-large marine submersible transport boat of claim 1, further comprising a designated uppermost line upon the submersible hull, while in operation the submersible hull being controllably moved by ballasting so that its uppermost line is kept around the uppermost position of the ultra-large marine submersible transport boat with regard to the vertical, around the uppermost line being constructed a deck walkway on which, when at or above sea level, personnel and equipment access is permitted.

23. The ultra-large marine submersible transport boat of claim 1, wherein the submersible hull's hollow interior cavity is provided with a series of axially spaced apart radial reinforcing elements which oppose radial deformation of the submersible hull and are positioned so that they do not interfere with the displacement of the collapsible bladders while filled with and emptied of the bulk liquids.

24. The ultra-large marine submersible transport boat of claim 1, wherein further being provided with an impervious command nacelle, mounted close to the upper side of a snorkel tower, the command nacelle being usually kept above the seawater during cruising, and hosting some of the electronics and some of the human interface of the ultra-large marine submersible transport boat.

25. An ultra-large marine submersible transportation supply arrangement used for supplying the bulk liquids to the ultra-large submersible transport boats of claim 1 and consisting of at least one of the ultra-large submersible transport boat and one specifically-built bulk liquids supply station erected in deep water adjacent to a seacoast that is close to at least one on-shore bulk liquid source the supply station hosting the ultra-large submersible transport boat, the supply station being provided with a supply pipeline terminated with at least one off-shore supply valve and with at least one bulk liquids supply connector that matches and is temporarily mated to the ultra-large marine submersible transport boats' bulk liquids transfer connectors for the supply station to feed bulk liquids into the collapsible bladders of the ultra-large submersible boat.

26. A method of loading large quantities of aqueous bulk liquids onto ultra-large marine submersible transportation boats using the supply arrangement of claim 25, the method of loading comprising:

the provision of the ultra-large marine submersible transportation supply arrangement and the implementation of the following operational phases:

a phase when the ultra-large marine submersible transport boat approaches the supply station for being filled with bulk liquids and is tugged into position adjacent to the supply station;

a phase when the ultra-large marine submersible transport boat is moored adjacent to the supply station;

a phase when the supply pipeline is brought into position onto the ultra-large marine submersible transport boat and the bulk liquids supply connector is mated to the bulk liquids transfer connector all connectors being uncapped, a phase when the ultra-large marine submersible transport boat is filled with bulk liquids by the following operational sub-phases:

(i) the transfer valves are opened, (ii) the supply valve is opened, (iii) the bulk liquid is transferred from the bulk liquid source through the supply pipeline into the collapsible bladders, (iv) during the filling of the collapsible bladders, the submersible hull is kept moored and is proportionally ballasted or deballasted as required, being kept at seawater level and in a horizontal and uppermost position by controllably introducing and removing hull ballast water into, respectively from, some of the ballast chambers, a phase when the bulk liquids supply connector is unmated from the bulk liquids transfer connector that then is capped, a phase when the supply pipeline, together with the supply valve and supply connector, is moved away from the ultra-large marine submersible transport boat, a phase when the ultra-large marine submersible transport boat is un-moored and tugged away from the supply station.

27. An ultra-large marine submersible transportation delivery arrangement used for delivering the bulk liquids from the ultra-large submersible transport boats of claim 1 and consisting of at least one of the ultra-large submersible transport boats and at least one specifically-built bulk liquids delivery station erected in deep water adjacent to a seacoast that is close to at least one on-shore bulk liquids user, the supply station hosting the ultra-large submersible transport boat;

the delivery station being provided with a delivery pipeline terminated with one off-shore delivery valve, and with one bulk liquids delivery connector that matches and is temporarily mated to the ultra-large marine submersible transport boats' bulk liquids transfer connectors, the delivery station being also provided with an inline delivery pump that feeds the delivery pipeline with the bulk liquids that is transferred from the collapsible bladders of the ultra-large submersible transport boat.

28. A method of unloading large quantities of aqueous bulk liquids from ultra-large marine submersible transportation boats using the delivery arrangement of claim 26, the method of unloading comprising:

the provision of the ultra the large marine submersible transportation delivery arrangement and the implementation of the following operational phases:

a phase when the ultra-large marine submersible transport boat approaches the delivery station for delivering its bulk liquids and is tugged into position adjacent to the delivery station, a phase when the ultra-large marine submersible transport boat is moored adjacent to the delivery station, a phase when the delivery pipeline is brought into position onto the ultra-large marine submersible transport boat together with the delivery pump and the bulk liquids delivery connector is mated to the bulk liquids transfer connector all connectors being uncapped, a phase when the ultra-large marine submersible transport boat delivers its contained bulk liquids by the following operational sub-phases:

(i) the transfer valves are opened, (ii) the delivery valve is opened, (iii) the bulk liquid is transferred from the collapsible bladders to the user of the bulk liquid by simultaneously emptying the collapsible bladders with the delivery pump through the delivery pipeline, (iv) during the emptying of the collapsible bladders, the submersible hull is kept moored and is proportionally de-ballasted or ballasted as required, being kept at seawater level and in a horizontal and uppermost position by removing and introducing hull ballast water from, respectively into, some of the ballast chambers, a phase when the bulk liquids delivery connector is unmated from the bulk liquids transfer connector that then is capped, a phase when the delivery pipeline together with the delivery pump, the delivery valve, and the delivery connector, is moved away from the ultra-large marine submersible transport boat, a phase when the ultra-large marine submersible transport boat is un-moored and tugged away from the delivery station.

29. A method of transporting large quantities of aqueous bulk liquids with ultra-large marine submersible transportation boats from claim 1 comprising:

the provision of the ultra-large marine submersible boat and also the implementation of a travel period while the ultra-large marine submersible transport boat cruises on a route of choice, at speeds and depths of choice, while the ultra-large marine submersible transport boat is kept in a substantially uppermost and horizontal position and at controlled depths by ballasting of the ballast chambers.

30. A method of manufacturing of the ultra-large marine submersible transport boat's submersible hull from claim 1, the method of manufacturing comprising:

forming precast panels onshore, manufactured separately of each other in dry dock and left to cure, each precast panel containing at least one ballast chamber that makes it floatable, the precast panels, being engineered to construct the submersible hull by their assembling, putting the cured precast panel in flotation and towing them while floating to a marine assembling yard in the seawater at least as deep as the maximum transversal diameter of the submersible hull, assembling the precast panels to each other to form the submersible hull in the marine assembly yard.

31. The method of manufacturing of claim 30, wherein during manufacturing, the precast panels before being attached to each other, are pulled above the water onto an assembling floating platform that is provided with support rollers that can be substantially aligned with the curved surface of the inner shell of the submersible hull to be built, the precast panels being assembled to each other and their inter-panel gap being filled with an assembly seam that is poured in place so that larger multi-panel annular sections are built, the multi-panel annular sections at their turn being coaxially assembled to each other to form the complete submersible hull, the submersible hull having some hull openings enabling the assembling floating platforms caught inside the submersible hull's hollow interior cavity to be disassembled into smaller pieces and extracted from the assembled submersible hull through its hull openings.

* * * * *